US010660823B2

(12) United States Patent
Shluzas et al.

(10) Patent No.: US 10,660,823 B2
(45) Date of Patent: May 26, 2020

(54) SYSTEM AND METHOD FOR INJECTION COMPONENT PREPARATION

(71) Applicant: Credence Medsystems, Inc., Menlo Park, CA (US)

(72) Inventors: Alan E. Shluzas, San Carlos, CA (US); Stephen H. Diaz, Palo Alto, CA (US)

(73) Assignee: CREDENCE MEDSYSTEMS, INC., Menlo Park, CA (US)

( * ) Notice: Subject to any disclaimer, the term of this patent is extended or adjusted under 35 U.S.C. 154(b) by 665 days.

(21) Appl. No.: 15/418,643

(22) Filed: Jan. 27, 2017

(65) Prior Publication Data

US 2017/0216143 A1 Aug. 3, 2017

Related U.S. Application Data

(60) Provisional application No. 62/304,139, filed on Mar. 4, 2016, provisional application No. 62/289,145, filed on Jan. 29, 2016.

(51) Int. Cl.
*A61J 1/20* (2006.01)

(52) U.S. Cl.
CPC ..... *A61J 1/2093* (2013.01); *A61J 1/2037* (2015.05); *A61J 1/2068* (2015.05); *A61J 1/2075* (2015.05);
(Continued)

(58) Field of Classification Search
CPC ..... A61J 1/2013; A61J 1/2058; A61J 1/2089; A61J 1/2096
See application file for complete search history.

(56) References Cited

U.S. PATENT DOCUMENTS 4,689,042 A * 8/1987 Sarnoff ..... A61M 5/2066 604/136
9,925,333 B2 * 3/2018 Hooven ..... A61M 5/152
2002/0123719 A1 * 9/2002 Lavi ..... A61J 1/2089 604/82

FOREIGN PATENT DOCUMENTS

WO WO 2005/120431 12/2005
WO WO 2007/122209 11/2007
(Continued)

OTHER PUBLICATIONS

PCT International Search Report for PCT/US2017/015511, Applicant: Credence MedSystems, Inc., Form PCT/ISA/210 and 220, dated May 2, 2017 (4pages).
(Continued)

*Primary Examiner* — Leslie R Deak
(74) *Attorney, Agent, or Firm* — Vista IP Law Group LLP

(57) ABSTRACT

An assembly for mixing drug components includes a housing to at least partially hold a first drug component container and a second drug component container. The assembly also includes a transfer member having first and second ends to fluidly couple the respective first and second drug component containers. The assembly further includes a pressure member to fluidly couple the first drug component container to a pressure generation chamber. In addition, the assembly includes an energy storage member to generate pressure in the pressure generation chamber to transfer a fluid from the first drug component container into the second drug component container. Moreover, the assembly includes an exit member to fluidly couple the second drug component container to an exterior of the assembly.

20 Claims, 45 Drawing Sheets

(52) U.S. Cl.
CPC ..... *A61J 1/2089* (2013.01); *A61J 1/2096* (2013.01); *A61J 1/2013* (2015.05); *A61J 1/2017* (2015.05); *A61J 1/2055* (2015.05); *A61J 1/2058* (2015.05); *A61J 1/2065* (2015.05)

(56) References Cited

FOREIGN PATENT DOCUMENTS

| | | |
|---|---|---|
| WO | WO 2010/043685 | 4/2010 |
| WO | WO 2011/139921 | 11/2011 |

OTHER PUBLICATIONS

PCT Written Opinion of the International Search Authority for PCT/US2017/015511, Applicant: Credence MedSystems, Inc., Form PCT/ISA/237, dated May 2, 2017 (6pages).
PCT International Preliminary Report on Patentability (Chapter I of the Patent Cooperation Treaty) for PCT/US2017/015511, Applicant: Credence MedSystems, Inc., Form PCT/IB/326 and 373, dated Aug. 9, 2018 (8pages).

* cited by examiner

SYSTEM AND METHOD FOR INJECTION COMPONENT PREPARATION

CROSS-REFERENCE TO RELATED APPLICATIONS

The present application claims the benefit under 35 U.S.C. § 119 to U.S. Provisional Application Ser. No. 62/289,145 filed on Jan. 29, 2016 entitled "SYSTEM AND METHOD FOR INJECTION COMPONENT PREPARATION," and U.S. Provisional Application Ser. No. 62/304,139 filed on Mar. 4, 2016 entitled "SYSTEM AND METHOD FOR INJECTION COMPONENT PREPARATION". The contents of the aforementioned patent applications are hereby expressly and fully incorporated by reference in their entirety, as though set forth in full.

FIELD OF THE INVENTION

The present invention relates generally to injection systems, devices, and processes for facilitating various levels of control over medication preparation and infusion, and more particularly to systems and methods related to safe preparation and injection configurations in healthcare environments.

BACKGROUND

Millions of syringes are consumed in healthcare environments every day to inject medications into patients. Some medications are purchased in two or more separate parts and then combined by a medical professional to create a prepared solution which may be loaded into a syringe for injection into a patient. For example, there are certain drugs which are stored in powdered/dry form until immediately before use. Such drugs may be combined with a liquid component and mixed therewith to produce what may be termed a "prepared liquid drug" which may be loaded into a syringe and injected into a patient. By way of nonlimiting example, the drug sold under the tradename Remicade® by Janssen Biotech, Inc., also known as "infliximab", is one such drug that is combined with sterilized water immediately before injection, carefully mixed, and then loaded into a syringe for injection into a patient to treat diseases such as Crohn's Disease and/or rheumatoid arthritis. Referring to FIG. 1, conventionally, a fair bit of manual manipulation is conducted to prepare a two-part drug for injection. A container of a liquid component, such as sterilized water, may be provisioned along with a separate container of the powdered or dry drug component; additionally a needle and syringe may be provisioned to assist in the preparation steps and subsequent injection (2). The needle and syringe are assembled, and the needle distal tip is inserted across a septum seal of the liquid component container (4). A plunger of the syringe assembly is retracted relative to a syringe body of the syringe assembly to bring liquid from the liquid container into the syringe (6). The needle distal tip is then inserted across a septum seal of the drug component container (8) and liquid component is expelled into the powdered or dry drug component container by inserting the syringe plunger relative to the syringe body (10). With at least some of the liquid component and powdered or dry component combined together in the container that previously housed only the powdered or dry component, these components may be mixed (i.e., using manual manipulation, such as oscillatory motion) together, forming a prepared liquid drug (12). The container may be tipped while the plunger is retracted relative to the syringe body, to allow the prepared liquid drug to become transferred into the syringe (14). The needle/syringe assembly may be retracted from the septum seal of the container housing the prepared liquid drug (16), after which the drug may be administered to a patient by injection using the needle/syringe assembly (18). These steps require quite a bit of manual manipulation of containers and needle/syringe assemblies and can not only take valuable time, but also can expose the operator, such as a healthcare professional, to several positions of needle/sharp exposure—particularly when the syringe/needle assembly is being coupled and decoupled from one container to another, and during mixing if the needle remains positioned stabbed into the container housing the prepared liquid drug.

There is a need for improved injection systems which address the shortcomings of currently-available configurations. In particular, there is a need for systems, devices, and processes for facilitating various levels of control over medication preparation and infusion, and more particularly for systems and methods related to safe preparation and injection configurations in healthcare environments wherein two-part medications are utilized.

BRIEF DESCRIPTION OF THE DRAWINGS

In one embodiment, an assembly for mixing drug components includes a housing to at least partially hold a first drug component container and a second drug component container. The assembly also includes a transfer member having first and second ends to fluidly couple the respective first and second drug component containers. The assembly further includes a pressure member to fluidly couple the first drug component container to a pressure generation chamber. In addition, the assembly includes an energy storage member to generate pressure in the pressure generation chamber to transfer a fluid from the first drug component container into the second drug component container. Moreover, the assembly includes an exit member to fluidly couple the second drug component container to an exterior of the assembly.

In one or more embodiments, the assembly also includes a piston to generate pressure in the pressure generation chamber. The energy storage member may be configured to move the piston into the pressure generation chamber. The energy storage member may bias the piston to move into the pressure generation chamber to generate pressure therein.

Figure 1:
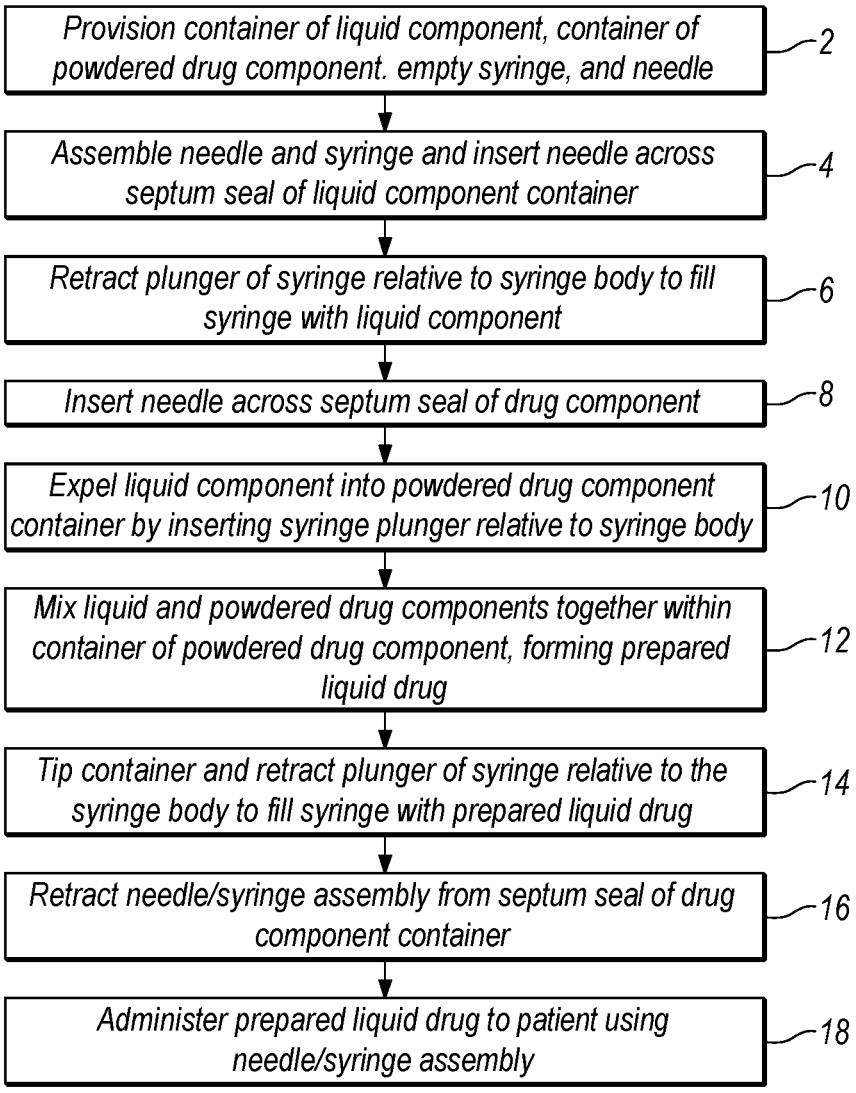
FIG. 1 (Prior Art)

In one or more embodiments, the piston includes the second drug component container. The assembly may also include a latch member to prevent insertion of the second drug component container into the assembly until the first drug component container is inserted into the assembly. The latch member may be a selectively rotatable ring.

In one or more embodiments, the assembly also includes a locking member having a locked configuration in which the locking member prevents the piston from moving into the pressure generation chamber to generate pressure therein, and an unlocked configuration in which the locking member does not prevent the piston from moving into the pressure generation chamber. The assembly may also include an actuation member manually manipulable to move the locking member from the locked configuration to the unlocked configuration. The assembly may also include a lockout member to prevent movement of the actuation member.

In one or more embodiments, the assembly also includes an exit interface to fluidly couple the assembly to a syringe.

The exit interface may be fluidly coupled to the exit member. The assembly may also include a one-way valve to prevent fluid from flowing from the first drug component container to the second drug component container, while allowing fluid to flow from the second drug component container to the first drug component container.

In one or more embodiments, the assembly also includes a transfer assembly disposed between the first and second drug component containers. The transfer assembly may include the transfer member. The transfer assembly may be fluidly coupled to the pressure member and the exit member. The open first end of the transfer member may have a geometry to limit an exit rate of a fluid.

In another embodiment, a method of mixing drug components includes inserting a first drug component container having a first drug component therein into a drug mixing assembly. The drug mixing assembly has a transfer member, a pressure member, and an exit member. Inserting the first drug component container into the drug mixing assembly inserts an open first end of the transfer member into the first drug component container. The method also includes inserting a second drug component container having a second drug component therein into the drug mixing assembly. Inserting the second drug component container into the drug mixing assembly inserts an open second end of the transfer member into the first drug component container, thereby fluidly coupling the first and second drug component containers via the transfer member. The method further includes releasing an energy storage member to automatically move a pressure fluid into the second drug component container via the pressure member to increase a pressure in the second drug component container, thereby forcing at least some of the second drug component to move from the second drug component container into the first drug component container. In addition, the method includes moving the drug mixing assembly to mix the first and second drug components in the first drug component container to form a prepared drug.

In one or more embodiments, the method also includes coupling a syringe to the drug mixing assembly such that the syringe is fluidly coupled to the first drug component container via the exit member. The method may also include withdrawing the prepared drug from the first drug component container and into the syringe through the exit member.

In one or more embodiments, releasing the energy storage member automatically moves a piston into a pressure generation chamber in the drug mixing assembly to move the pressure fluid from the pressure generation chamber into the second drug component container. The energy storage member may be biased to move the piston into the pressure generation chamber to generate pressure therein.

In one or more embodiments, the piston may include the second drug component container. Moving the piston into the pressure generation chamber may include moving at least a portion of the second drug component container into the pressure generation chamber. Releasing the energy storage member may include manipulating an actuation member.

BRIEF DESCRIPTION OF THE DRAWINGS

FIG. 1 illustrates various aspects of a conventional two part medication preparation protocol for syringe-based injection after mixing.

FIGS. 2A-2E illustrate various aspects of a multi-component medication preparation system configuration according to one embodiment wherein a liquid component and a powdered component may be combined and prepared for injection into a patient using a syringe.

Figure 2A:
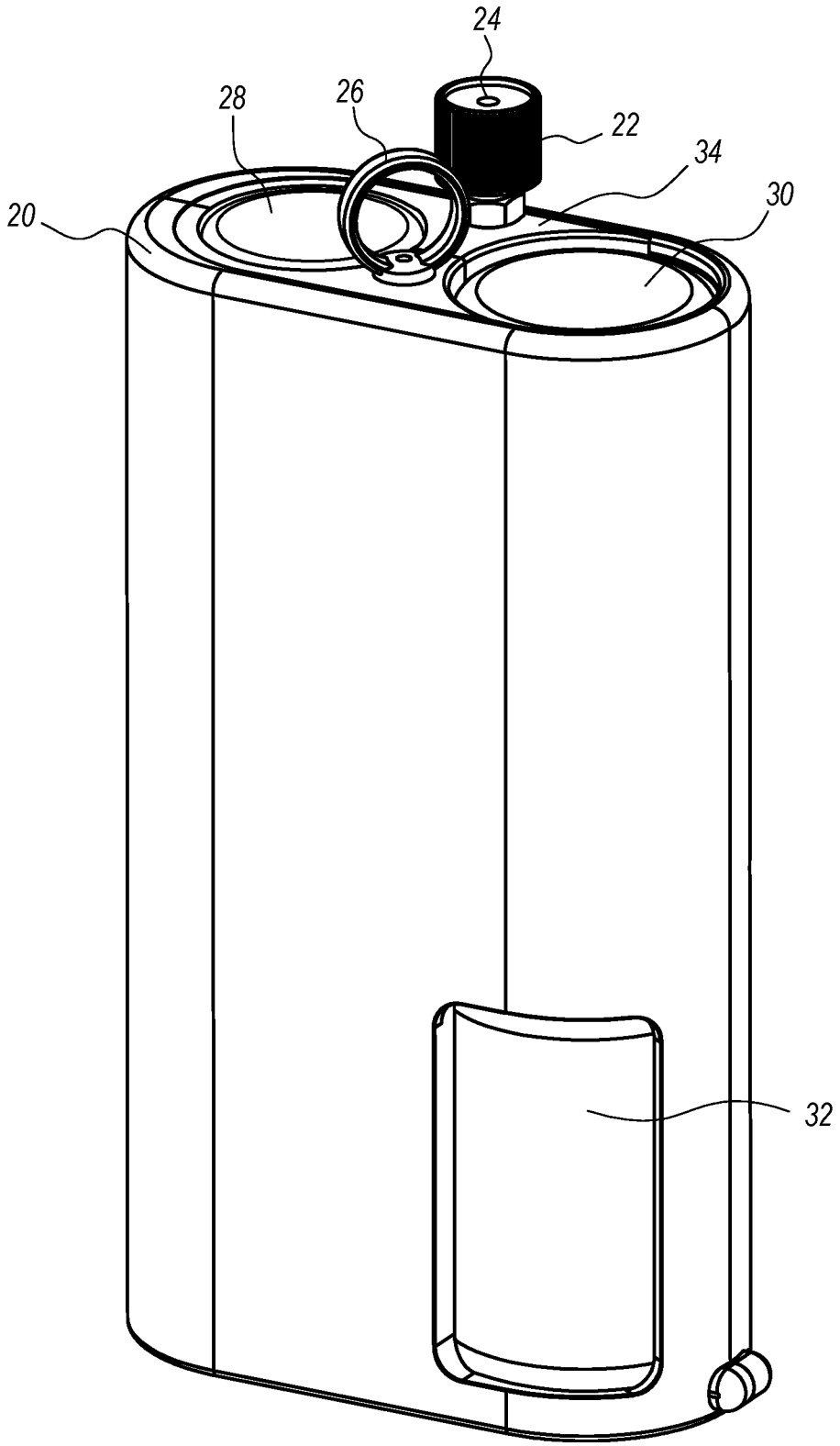
Figure 2B:
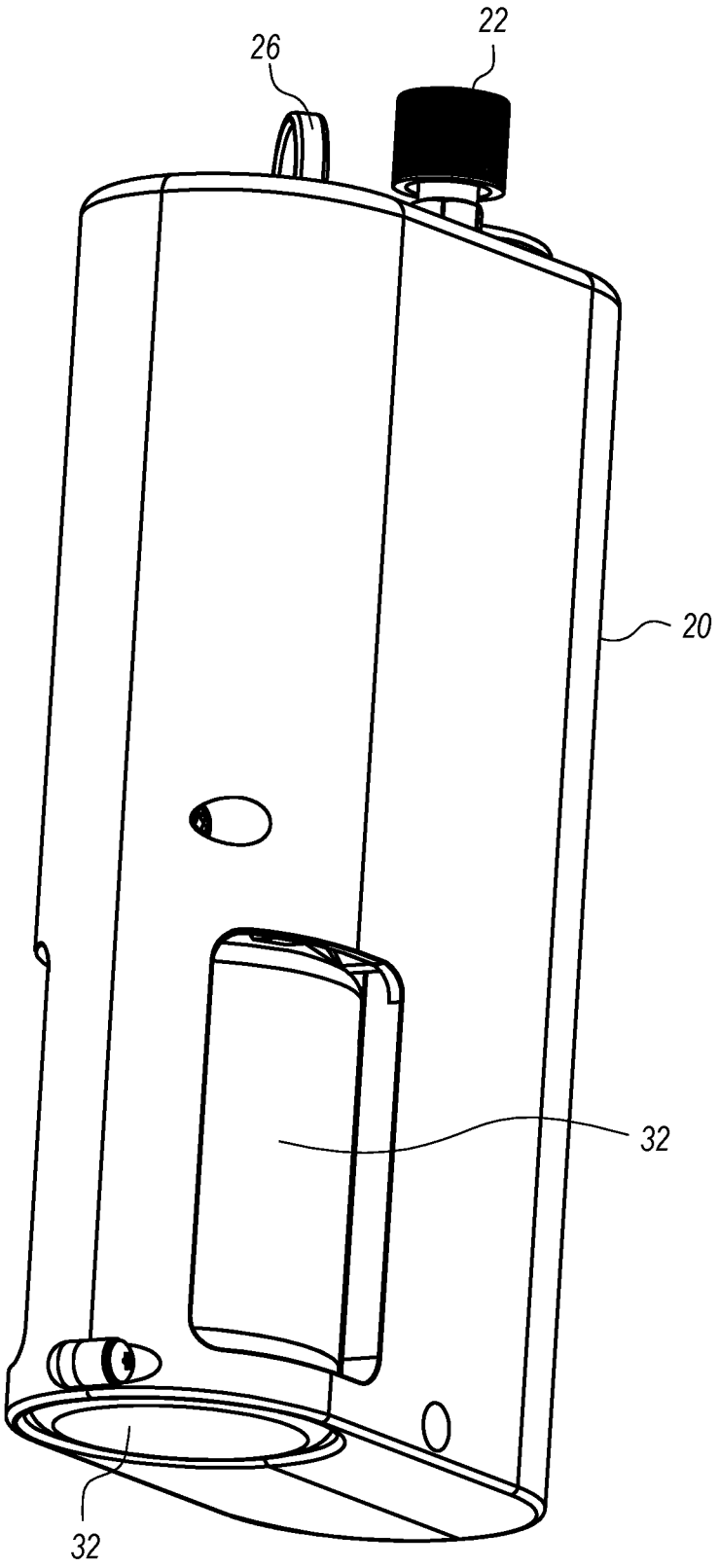
Figure 2C:
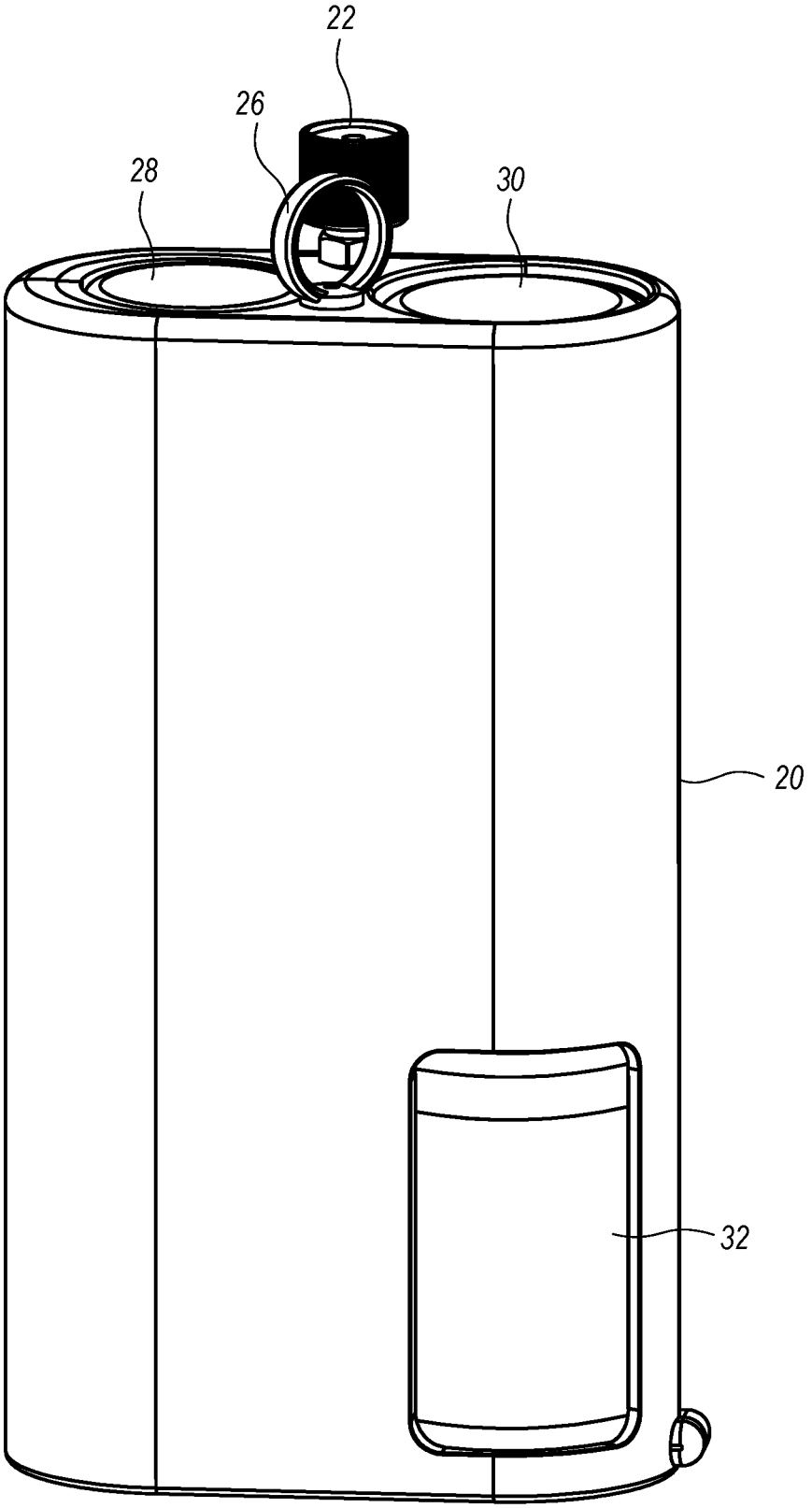
Figure 2D:
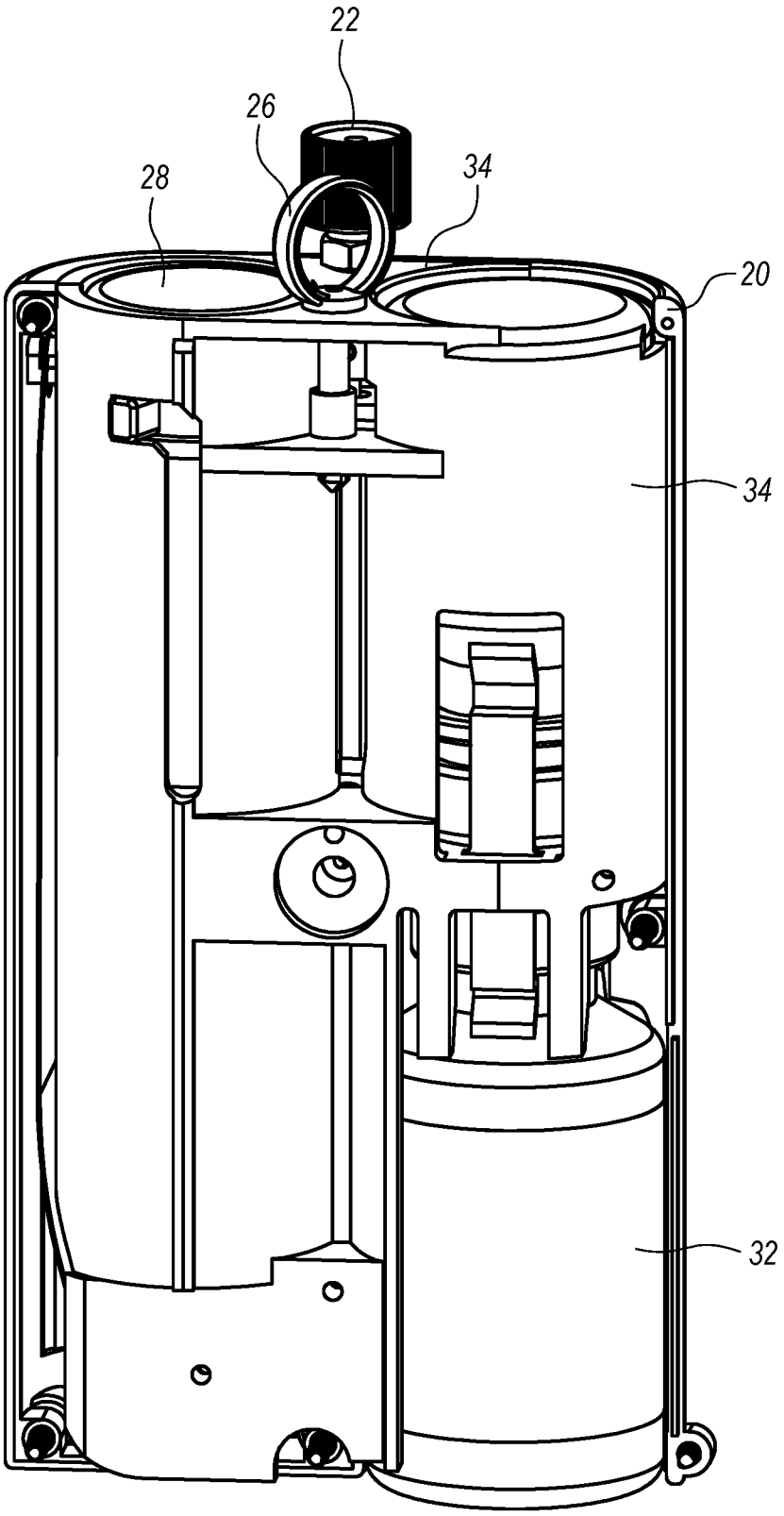
Figure 2E:
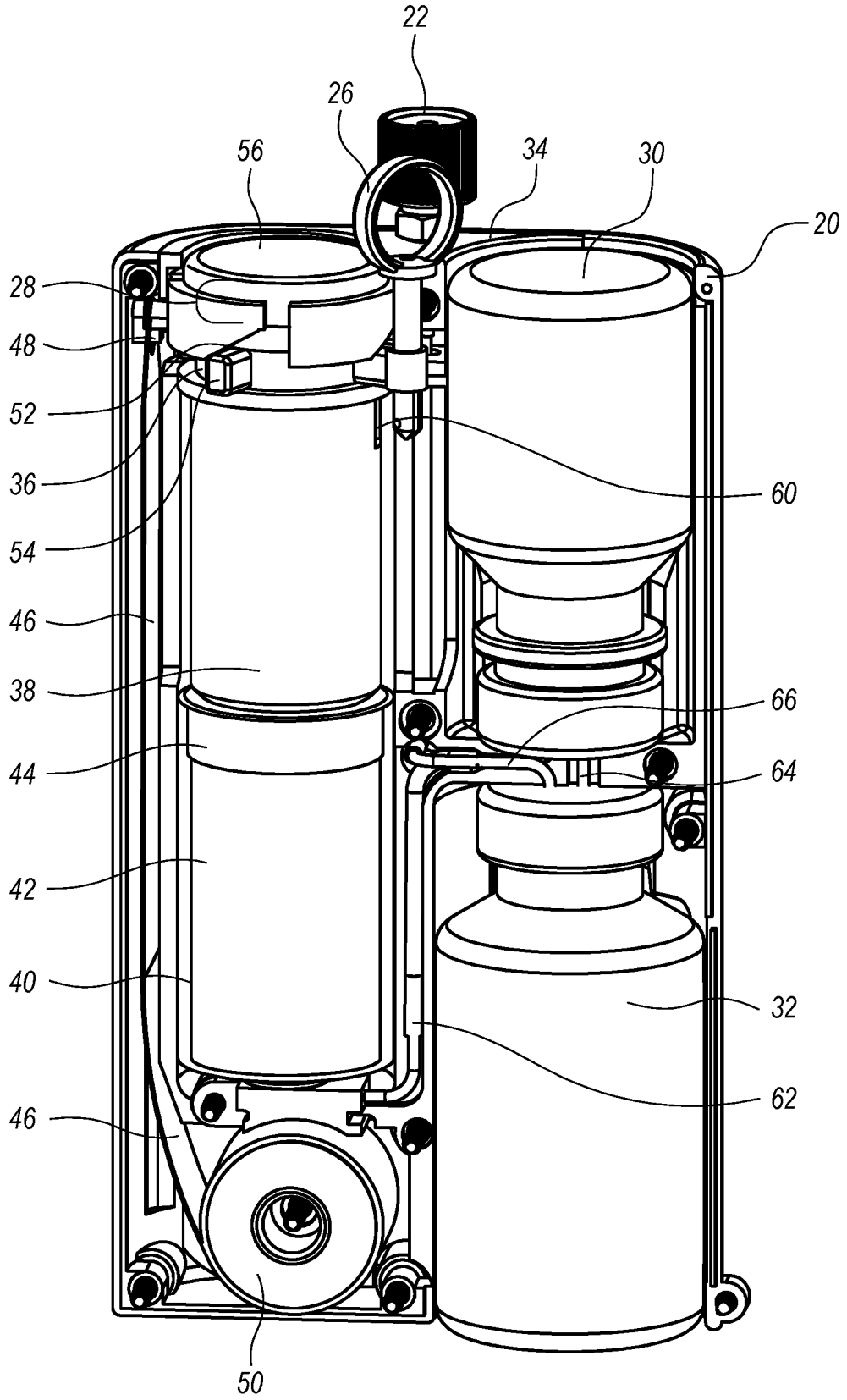
Figure 3:
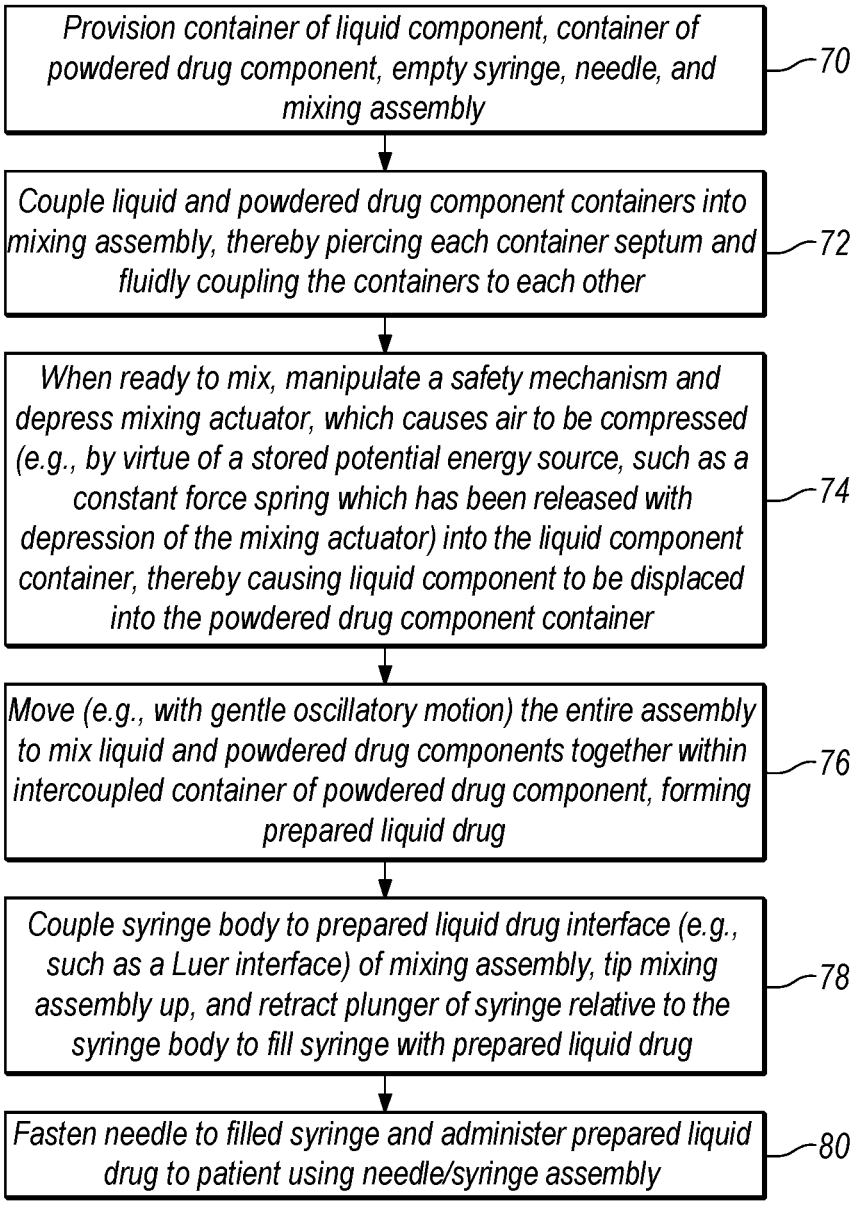

FIG. 3 illustrates various aspects of a two part medication preparation protocol for syringe-based injection after mixing according to one embodiment using a configuration such as that illustrated in FIGS. 2A-2E or FIGS. 4A-4J.

FIGS. 4A-4J illustrate various aspects of a multi-component medication preparation system configuration according to one embodiment wherein a liquid component and powdered component may be combined and prepared for injection into a patient using a syringe.

Figure 5:
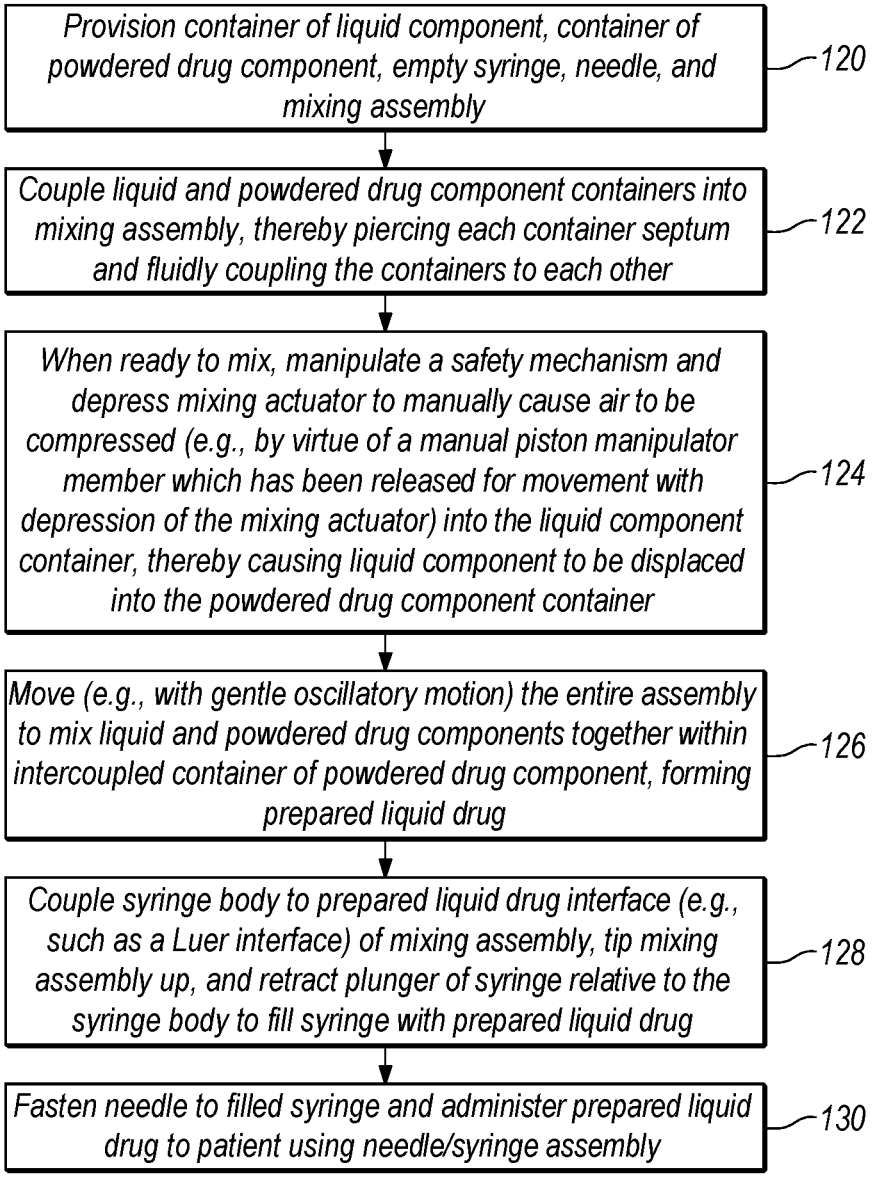
Figure 6A:
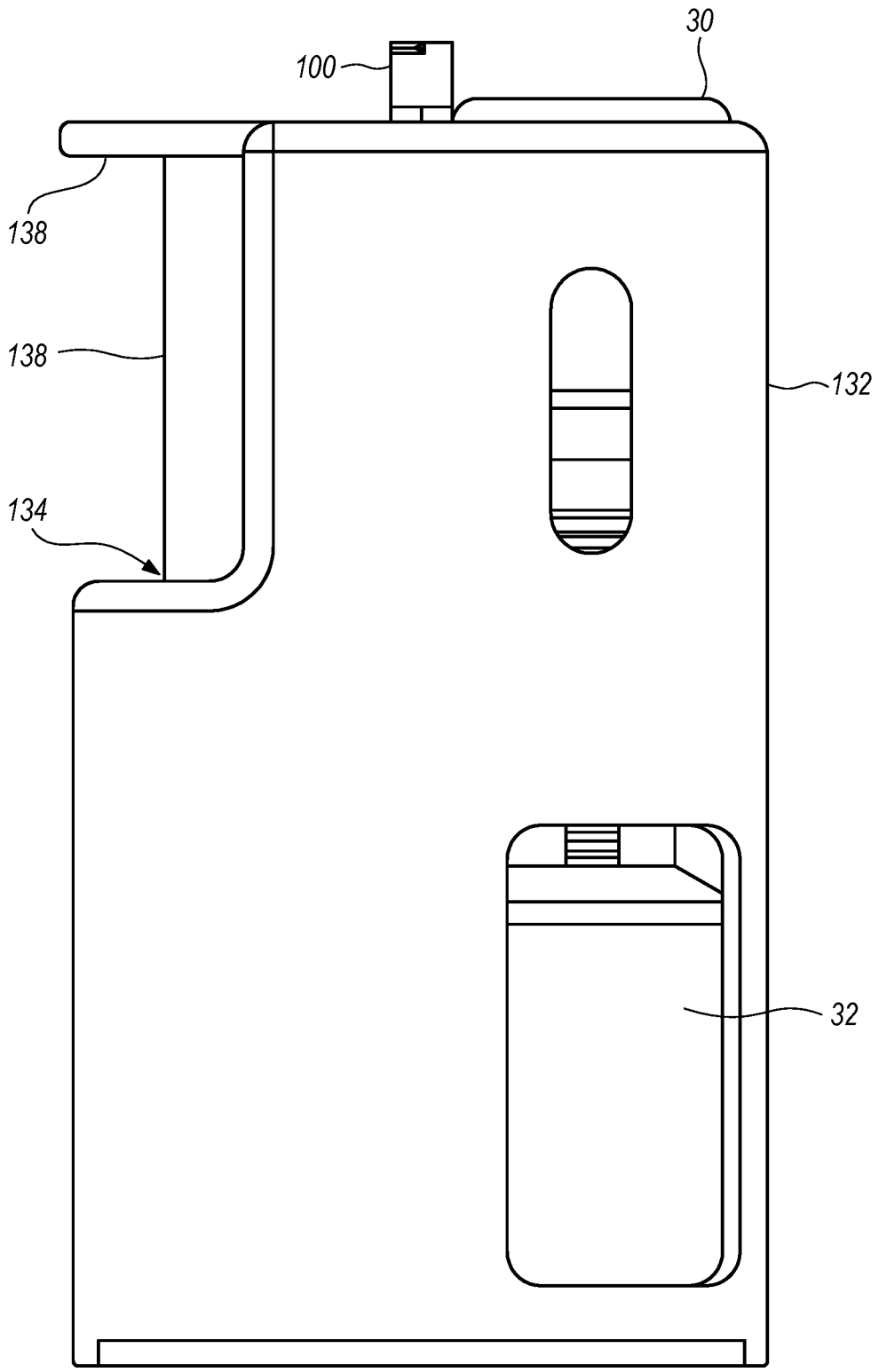
Figure 6B:
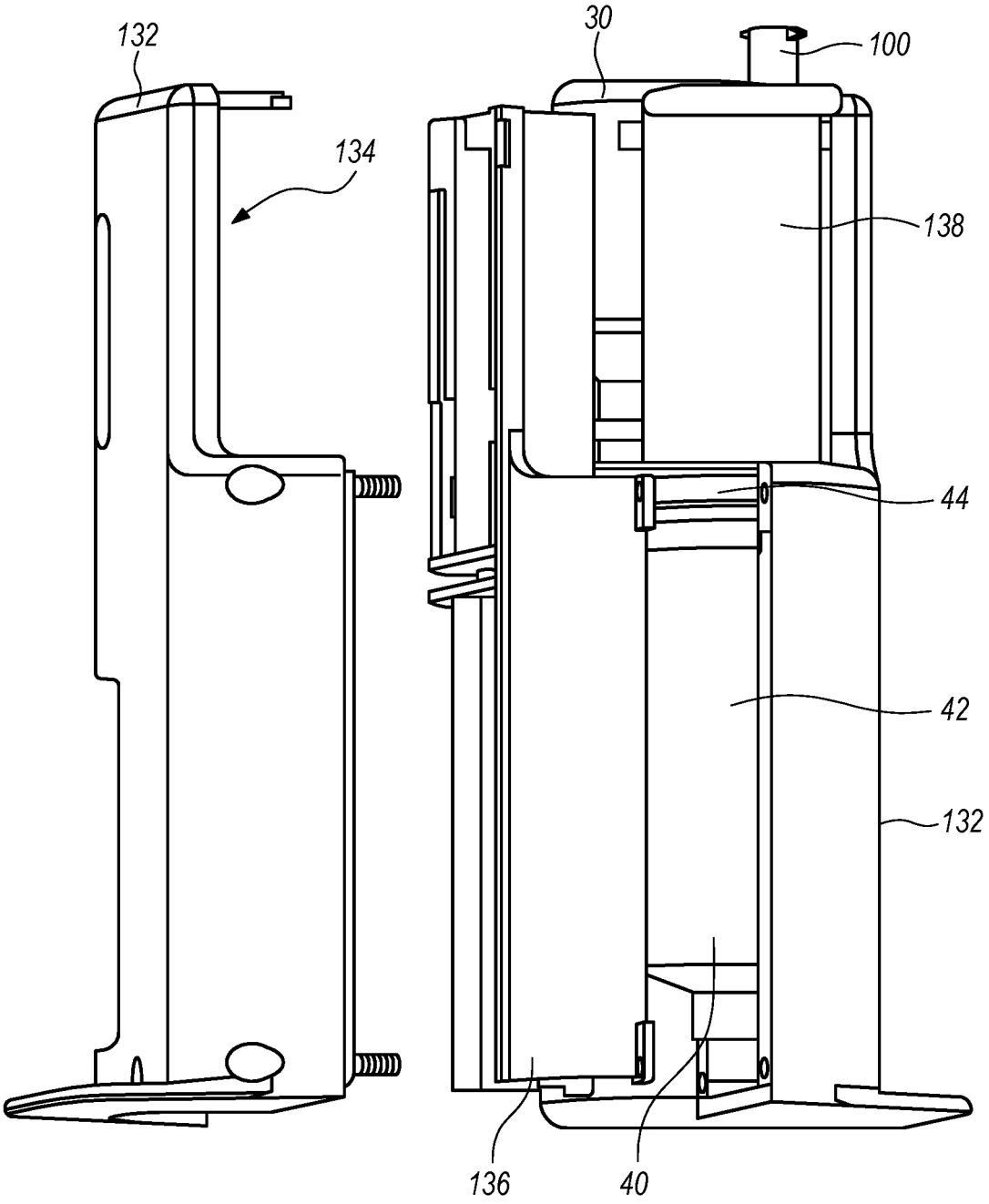
Figure 6C:
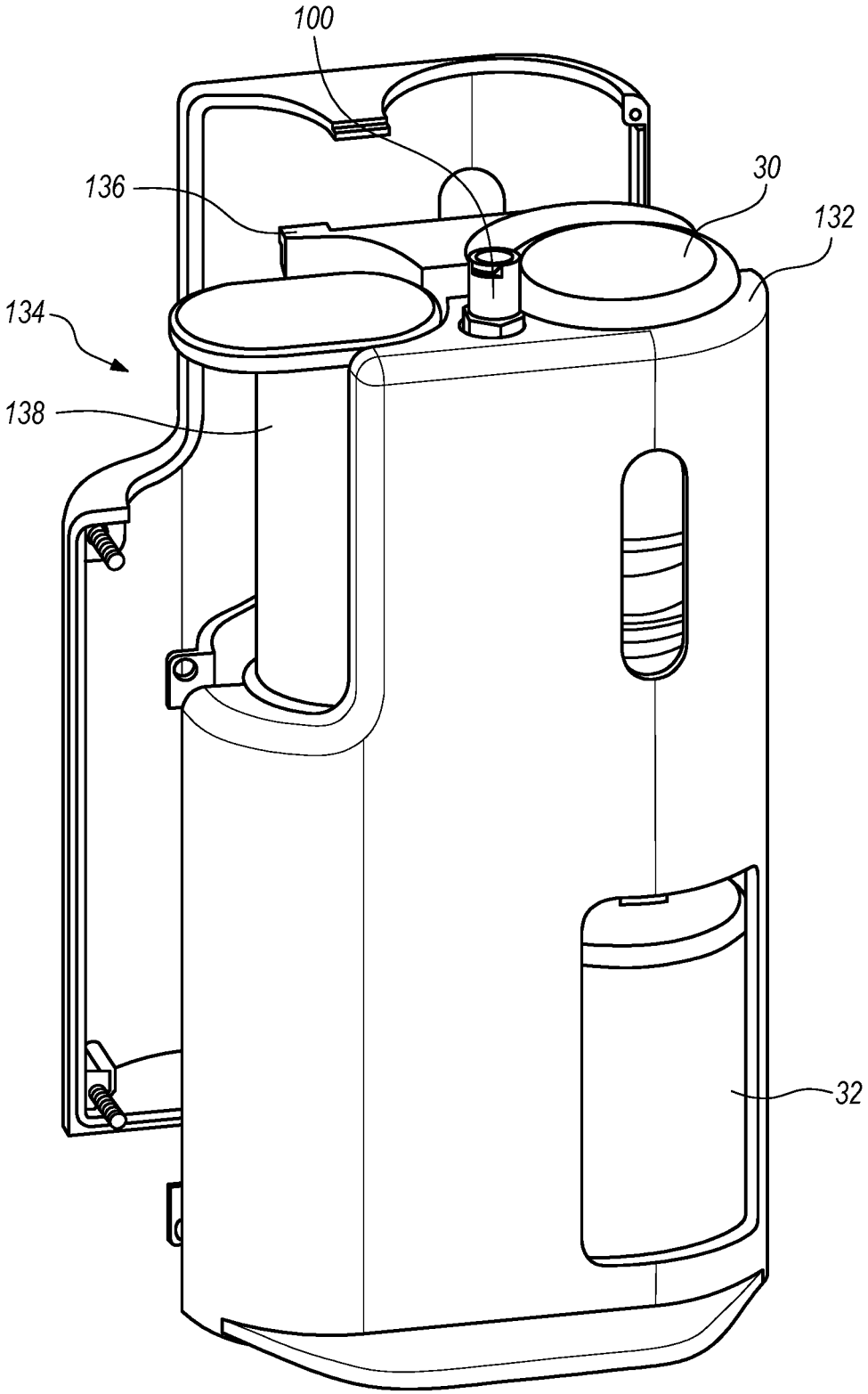

FIG. 5 illustrates various aspects of a two part medication preparation protocol for syringe-based injection after mixing according to one embodiment using a configuration such as that illustrated in FIGS. 6A-6C.

FIGS. 6A-6C illustrate various aspects of a multi-component medication preparation system configuration according to one embodiment wherein a liquid component and powdered component may be combined and prepared for injection into a patient using a syringe.

FIGS. 7A-7G illustrate various aspects of a multi-component medication preparation system configuration according to one embodiment wherein a liquid component and powdered component may be combined and prepared for injection into a patient using a syringe.

FIGS. 8A-8G illustrate various aspects of a multi-component medication preparation system configuration according to one embodiment wherein a liquid component and powdered component may be combined and prepared for injection into a patient using a syringe.

Figure 9A:
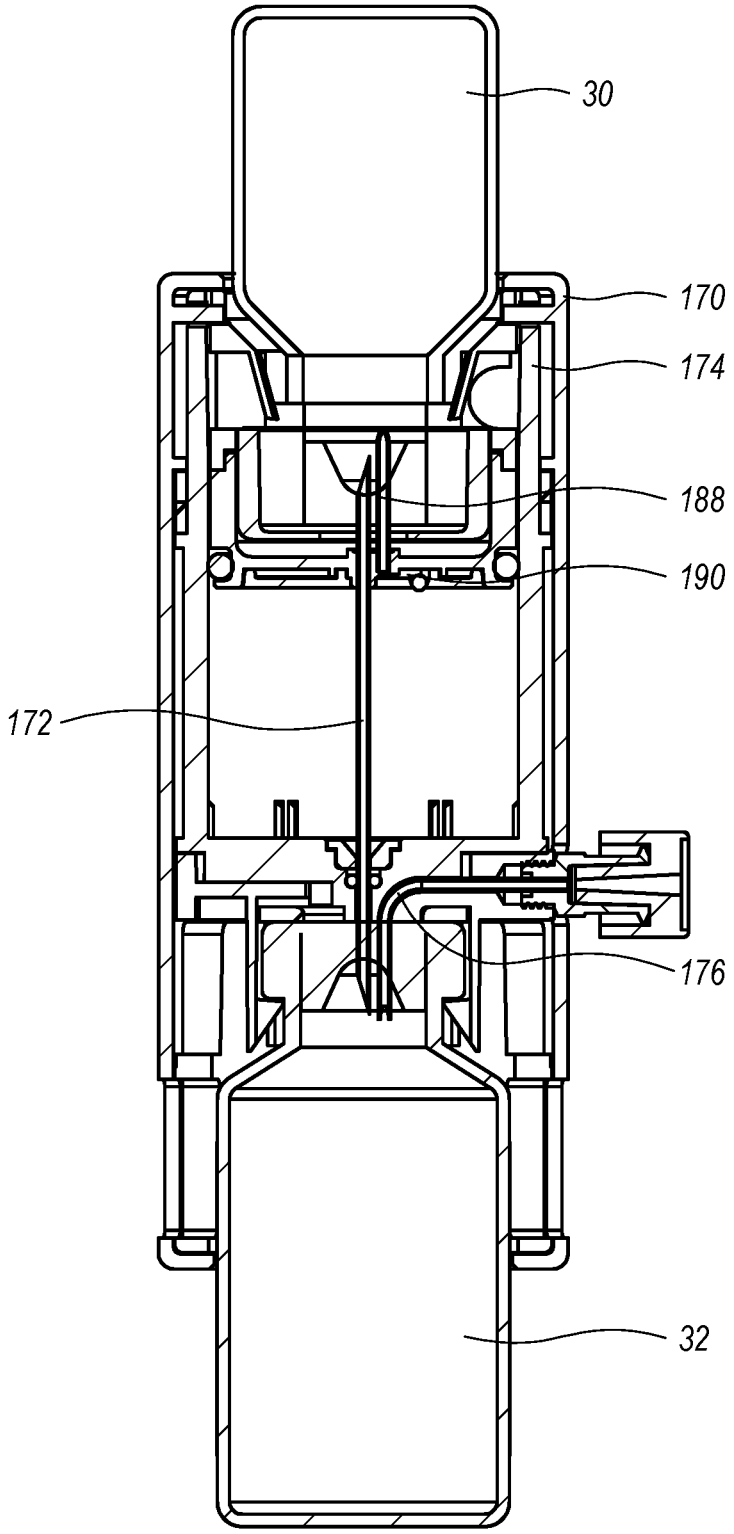
Figure 9B:
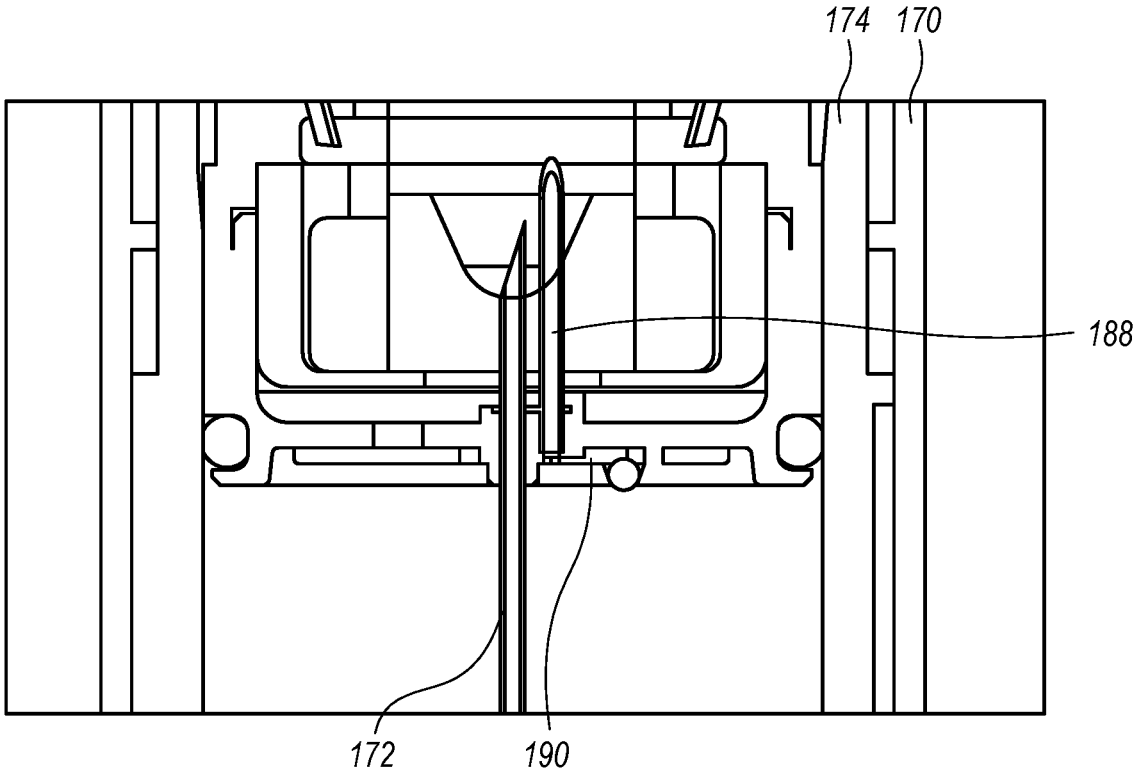

FIGS. 9A-9B illustrate various aspects of a multi-component medication preparation system configuration according to one embodiment wherein a liquid component and powdered component may be combined and prepared for injection into a patient using a syringe.

FIGS. 10A-10H illustrate various aspects of a multi-component medication preparation system configuration according to one embodiment wherein a liquid component and powdered component may be combined and prepared for injection into a patient using a syringe.

DETAILED DESCRIPTION

Figure 4A:
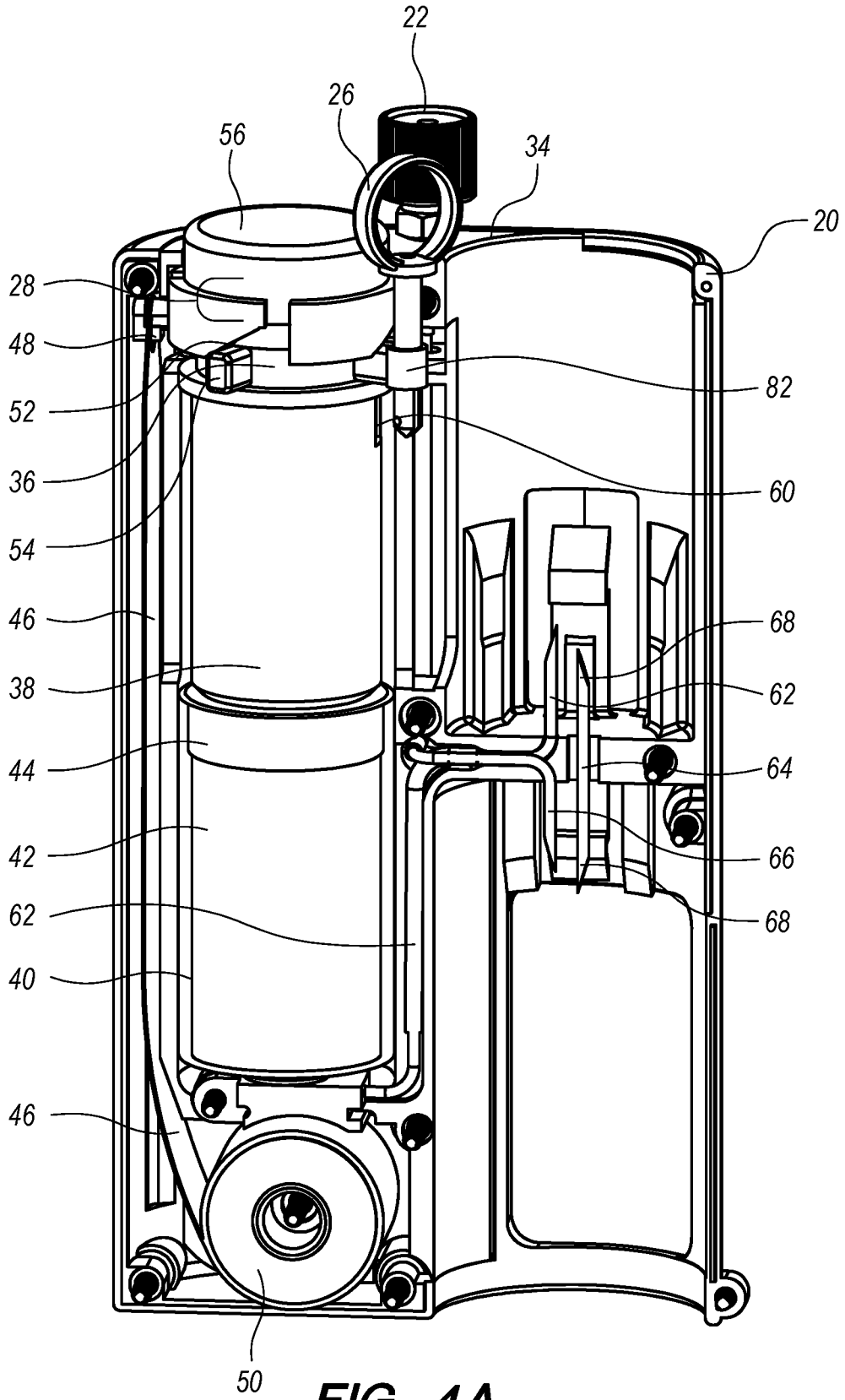

Referring to FIGS. 2A-2E, various partial orthogonal views of a mixing assembly are illustrated. Referring to FIGS. 2A-2C, a mixing assembly is depicted in three different orthogonal views having an outer housing assembly (20) containing an inner housing assembly (34), the combination of which is sized to be easily manipulated by an operator's hands. A liquid drug component container (30) and dry or powdered drug component container (32) are shown operatively coupled into the assembly of housings (20, 34), along with a lockout interface (26), such as a pin with finger manipulation interface, and a vent cap (22) through which an exit vent (24) is formed to allow for pressure to escape the operatively coupled drug component containers (30, 32), as described below. FIGS. 2D and 2E illustrate views similar to that of FIG. 2C, with the exception that in FIG. 2D, the front portion of the outer housing assembly (20) has been removed to show more of the inner housing assembly (34), and in FIG. 2E, the front portion of the inner housing assembly (34) has also been removed to depict other components of the mixing assembly. FIG. 4A illustrates a similar assembly to that of FIG. 2E, with the exception that in FIG. 4A, the liquid drug component container (30) and powdered drug component container (32) are not shown intercoupled with the rest of the depicted assembly; FIGS. 4A-4J illustrate further details of the subject mixing assembly and usage thereof.

Referring ahead to FIG. 3, a simplified and safety-optimized medication preparation process is facilitated by using a mixing assembly such as that illustrated in FIGS. 2A-2E. Initially a container of liquid component, such as sterilized water, oil, or other liquid, is provisioned, along with a container of powdered drug component to which the liquid is to be added; an empty syringe, needle, and mixing assembly, such as that illustrated in FIGS. 2A-2E, are also provisioned (70). The liquid and powdered drug component containers may be coupled into the mixing assembly, and the mixing assembly may be configured to automatically pierce each container septum and fluidly couple the containers to each other, such as by a transfer pipe as described in further detail below (72). When an operator is ready to mix the drug components, the operator may manipulate a safety mechanism, such as by pulling a pin from the assembly using the operator's fingers, and depressing a mixing actuation interface, which is configured to cause air to be compressed, such as by virtue of stored potential energy (such as a by a spring, such as a constant force spring which has been released with depression of the mixing actuator), into the liquid component container, thereby causing a volume of the liquid component to be displaced from its original container into the fluidly coupled powdered drug component container (74). With the powdered drug component container now containing at least some amount of both the liquid and powdered components, the entire mixing assembly may be gently moved about (such as by oscillatory motion using an operator's hand) to mix the components within the powdered drug component container, to form what may be termed a given volume of prepared liquid drug (78). With the prepared liquid drug appropriately mixed, a syringe body may be removably coupled to a prepared liquid drug removal interface, such as a Luer interface, of the mixing assembly, the mixing assembly may be manually tipped up relative to gravity-down/exit-up to ensure emptying of the prepared liquid drug from the powdered drug component container, and the plunger of the syringe assembly may be retracted to remove prepared liquid drug from the powdered drug component container of the mixing assembly into the syringe (78). With the syringe filled with an appropriate volume of prepared liquid drug, the syringe may be decoupled from the mixing assembly, the needle may be fastened to the syringe, and the prepared liquid drug may be administered to the patient via injection using the syringe/needle assembly. Such a configuration avoids much of the hazardous needle assembly operations and manipulations relative to the conventional configuration as illustrated in FIG. 1.

Again referring to FIGS. 4A-4J, a sequence of illustrative orthogonal views, some with intercoupled containers or housing components removed for illustrative purposes, are shown to illustrate functionality as presented in the process depicted in FIG. 3. Referring to FIG. 4A, a partial orthogonal view (i.e., with portions of the outer housing assembly (20) and inner housing assembly (34) removed to show inner components) of a ready-to-use mixing assembly is illustrated. The outer (20) and inner (34) housing assemblies for empty docking volumes to be occupied by liquid component and powdered drug component containers are described in reference to FIG. 4B below. A plunger member (38) is operatively coupled to the outer (20) and inner (34) housing assemblies and configured to be movable downward to insert a plunger member seal tip (44) into a volume (42) defined by a cylindrical member (40) which may contain a gas, such as nitrogen, or air. A lockout interface (26), such as a manipulatable pin, may be removably coupled to a portion of a load transfer member (36) and configured to prevent any motion of the plunger member (38) until the lockout interface (26) has been removed, as described below. An actuation interface member (28) may have a top surface (56) manipulatable and accessible to an operator, and may be configured such that upon application of a depression load at the top surface (56), if the lockout interface (26) has been removed (i.e., leaving the load transfer member (36) free to rotate), depression of the actuation interface member (28) causes the operatively coupled load transfer member (36) to rotate (i.e., by virtue of an angled surface (52) formed in the actuation interface member lower surface, which interfaces with a protrusion (54) formed in the load transfer member 36) into a slot (60) after which the load transfer member (36) and operatively coupled plunger member (38) are free to be depressed toward the cylindrical member (40). In the embodiment depicted in FIGS. 4A-4J, a source of potential energy, such as a constant force spring (such as those used in tape measures; suitable constant force springs are available from suppliers such as John Evans' Sons Inc. of Lansdale, Pa.), may be utilized to affirmatively pull the plunger member (38) toward the cylindrical member (40) upon the load transfer member (36) being freed to move in the direction toward the cylindrical member (40). Alternatively, a helically coiled or elastomeric compression or tension spring may be used as a source of potential energy. Also, a source of pressure such as a high pressure air bottle may be used as a source of potential energy to transfer the liquid. The amount of force the spring (46) exerts on the plunger member (38) may be tailored to increase or decrease the rate of mixing of the liquid and drug components. A large force springs will mix the components quickly, while a low force spring will mix the components slowly. FIG. 4A shows a constant force spring (46) coupled between a spring reel (50) and the load transfer member (36) at a coupling point (48). FIG. 4A also shows a vented cap (22) placed upon an exit interface (such as a Luer interface) configured to be interfaced with a counterpart interface of a syringe body, as described below.

Figure 4B:
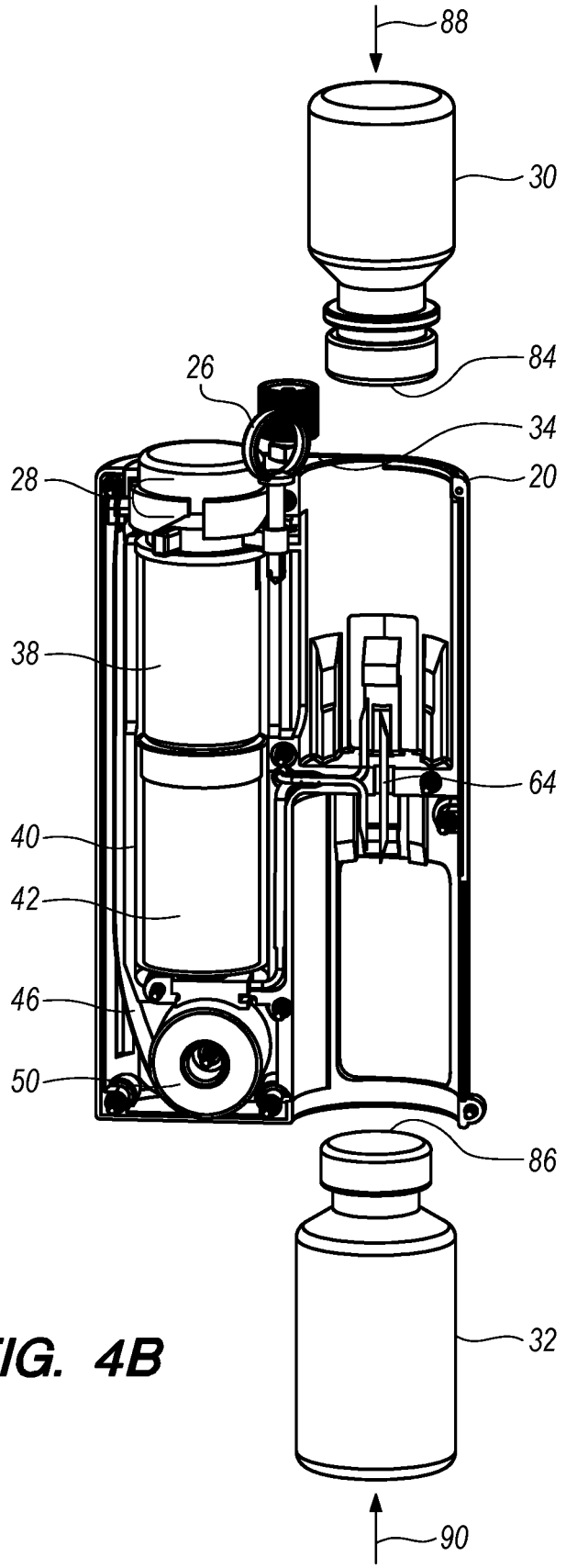
Figure 4C:
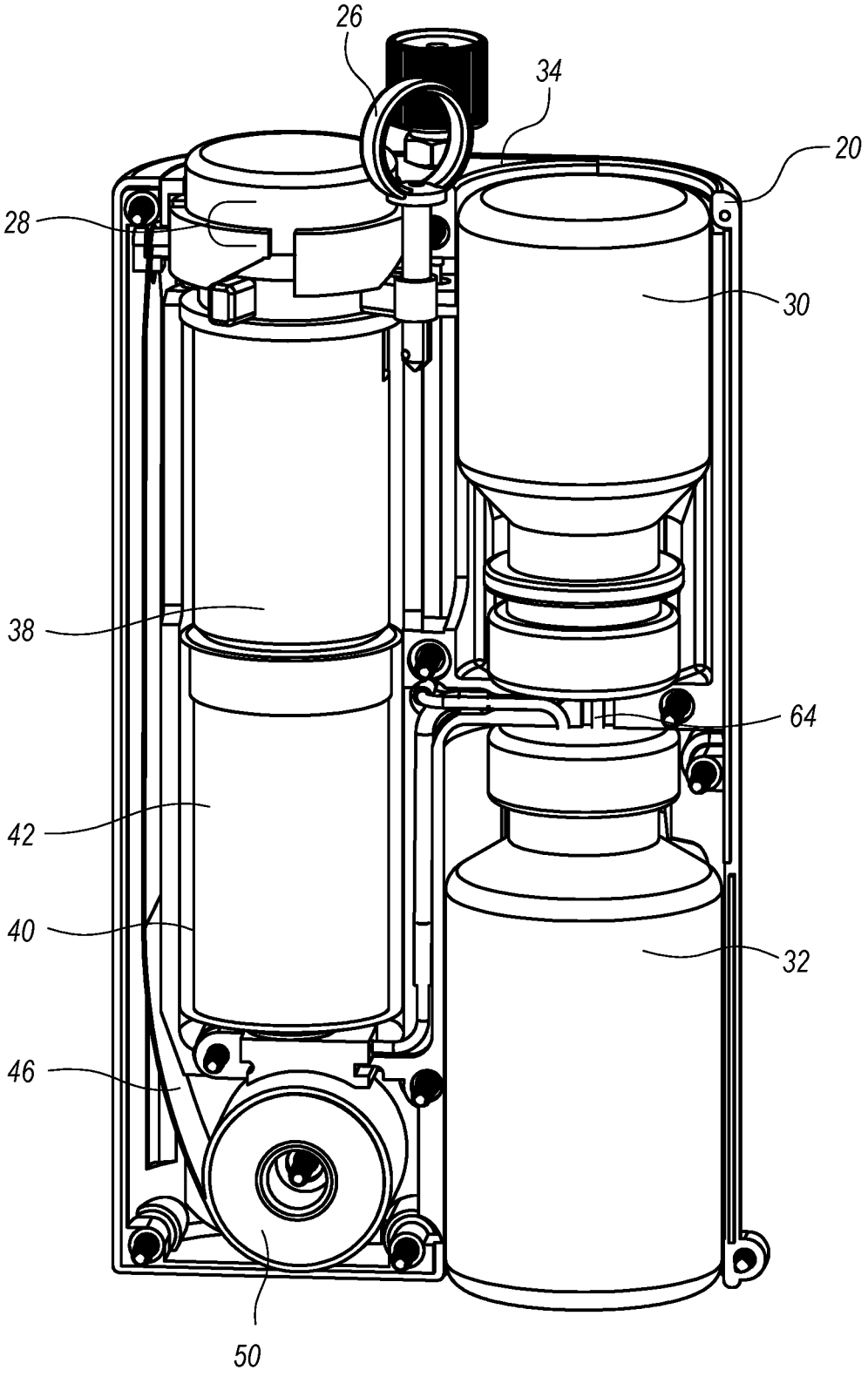
Figure 4D:
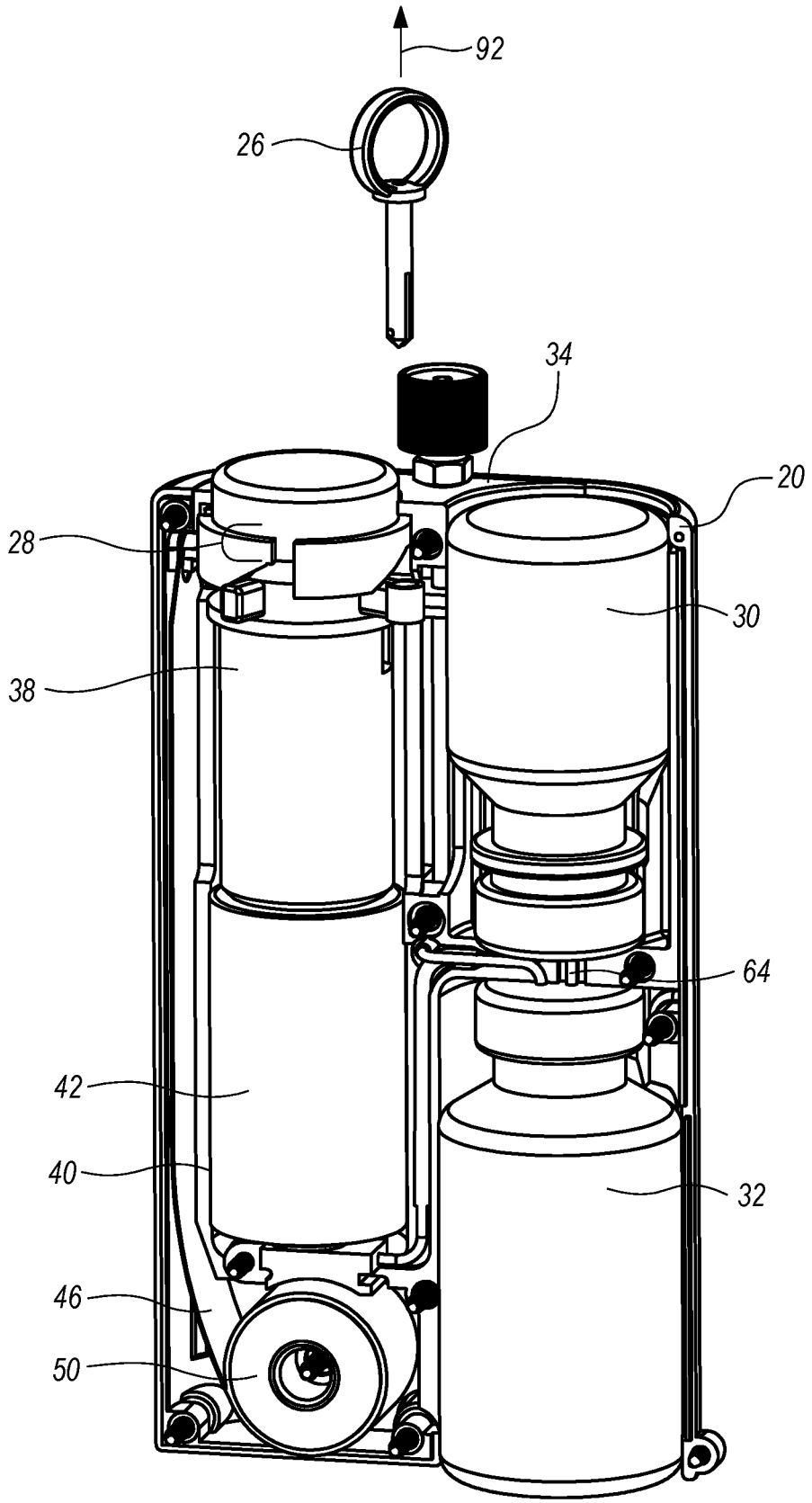
Figure 4E:
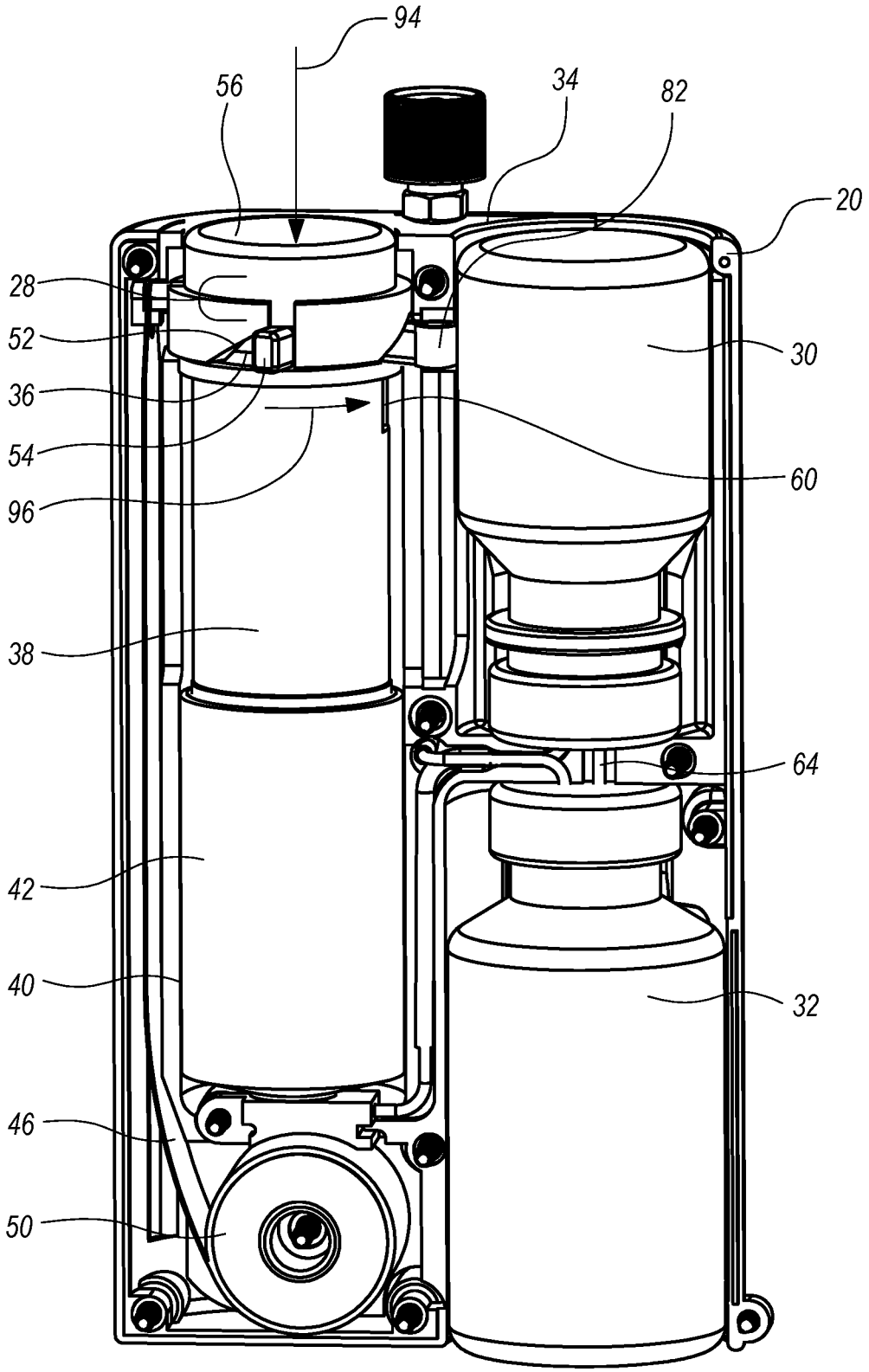
Figure 4F:
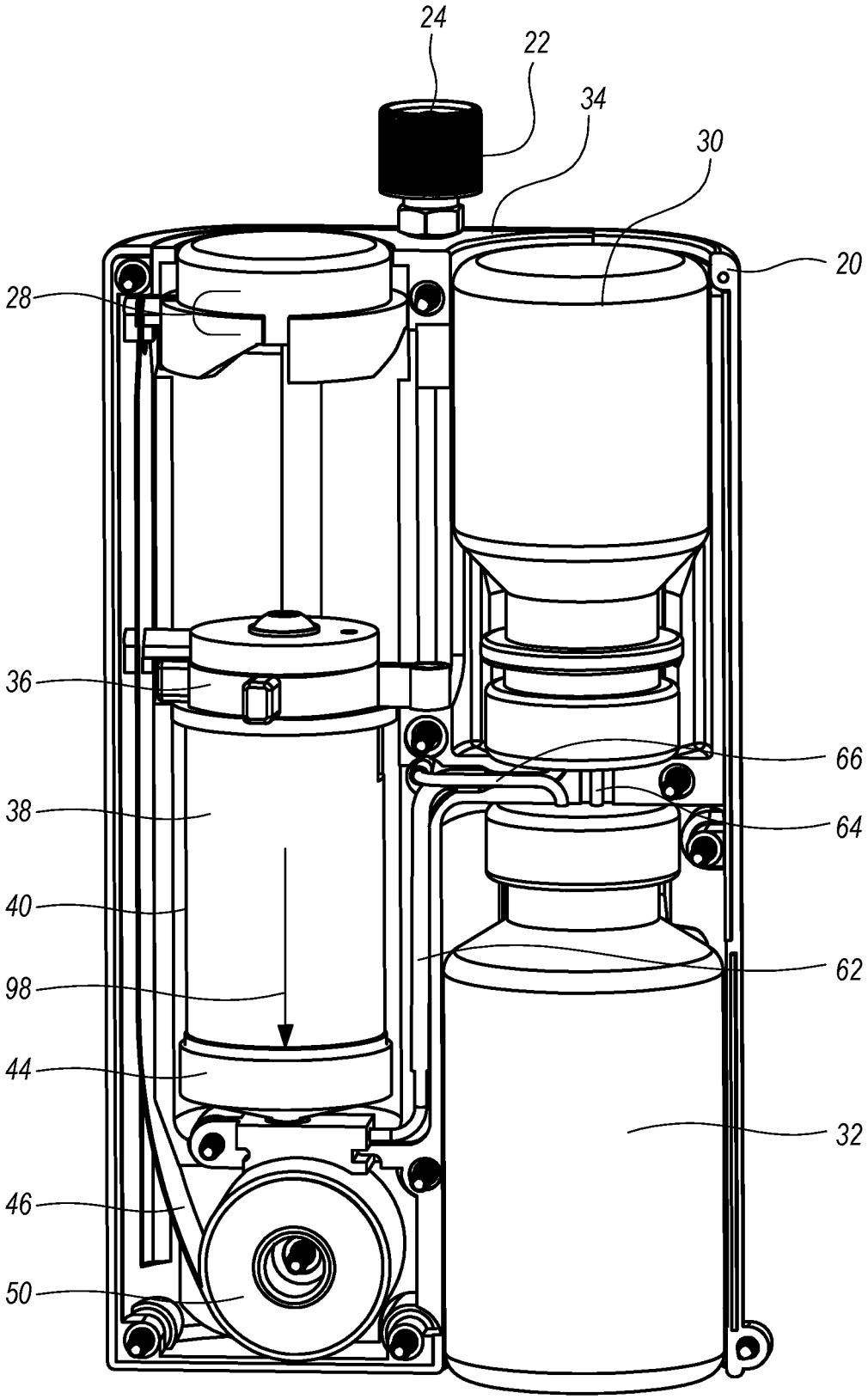
Figure 4G:
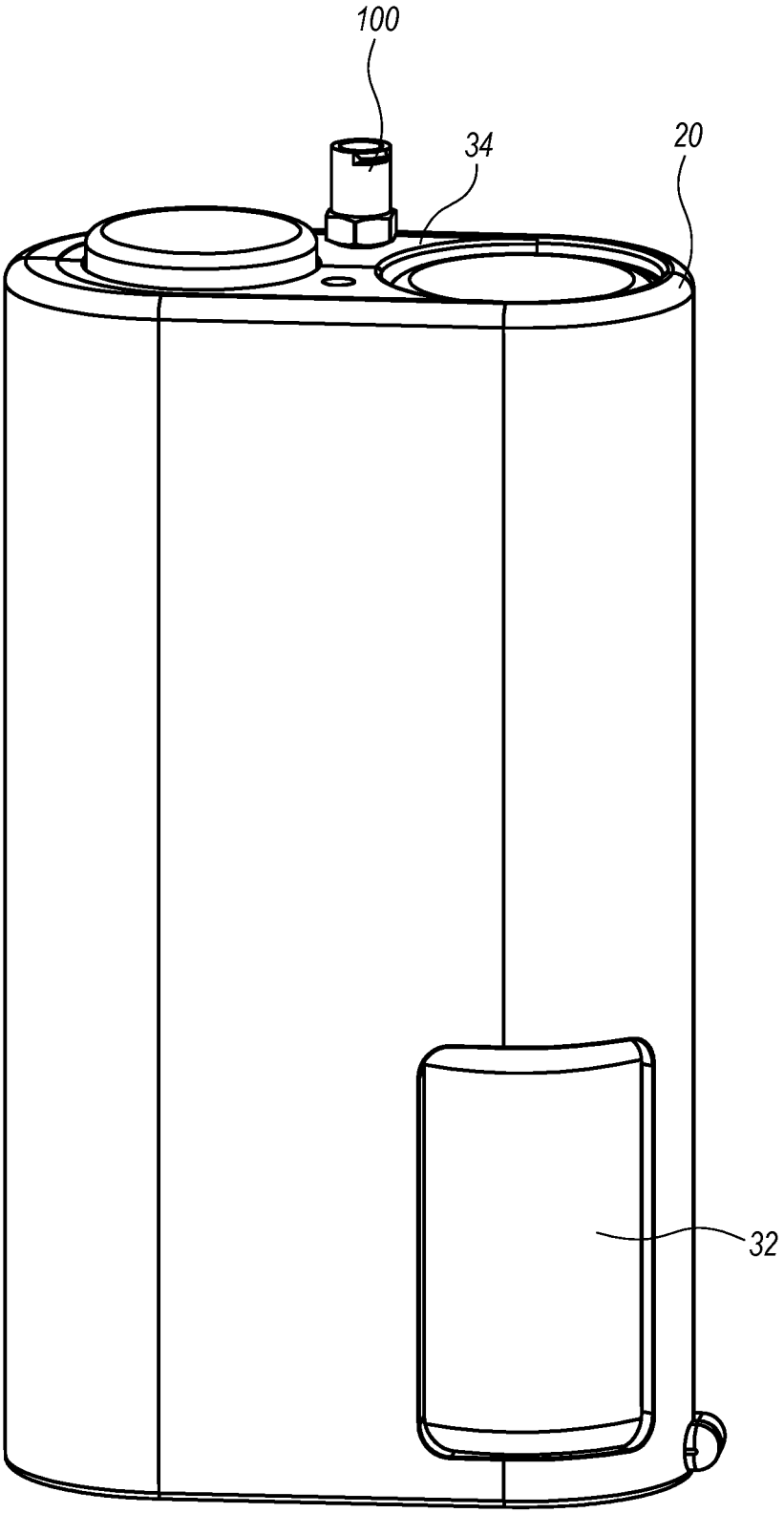
Figure 4H:
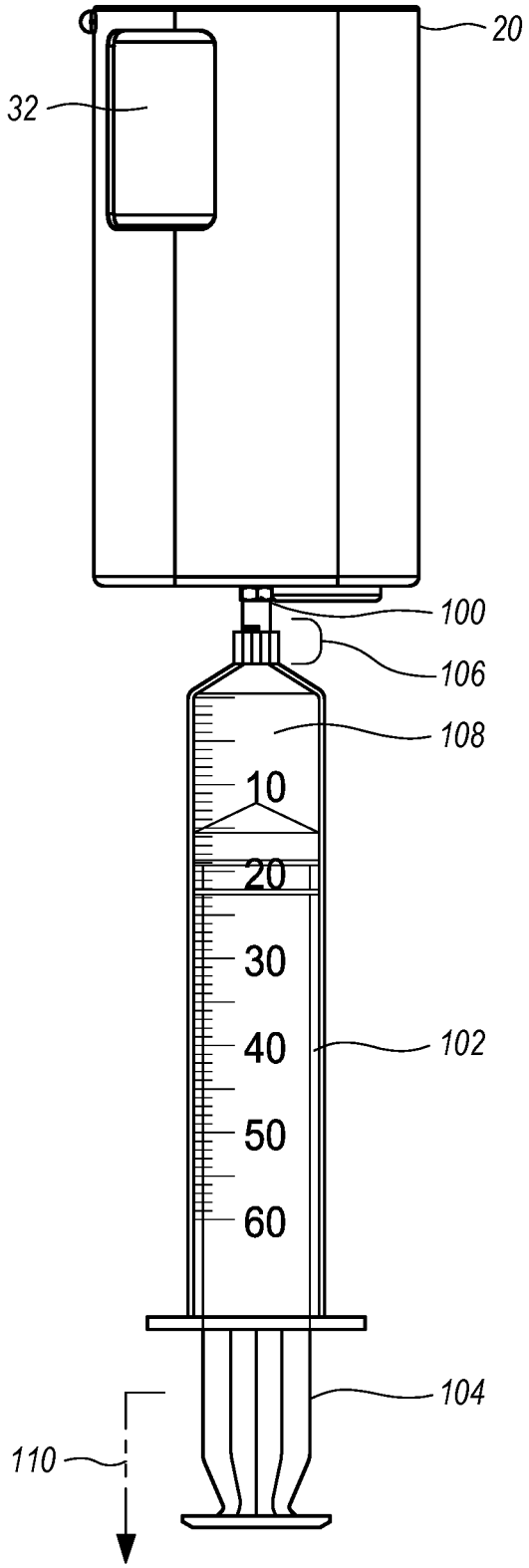
Figure 4I:
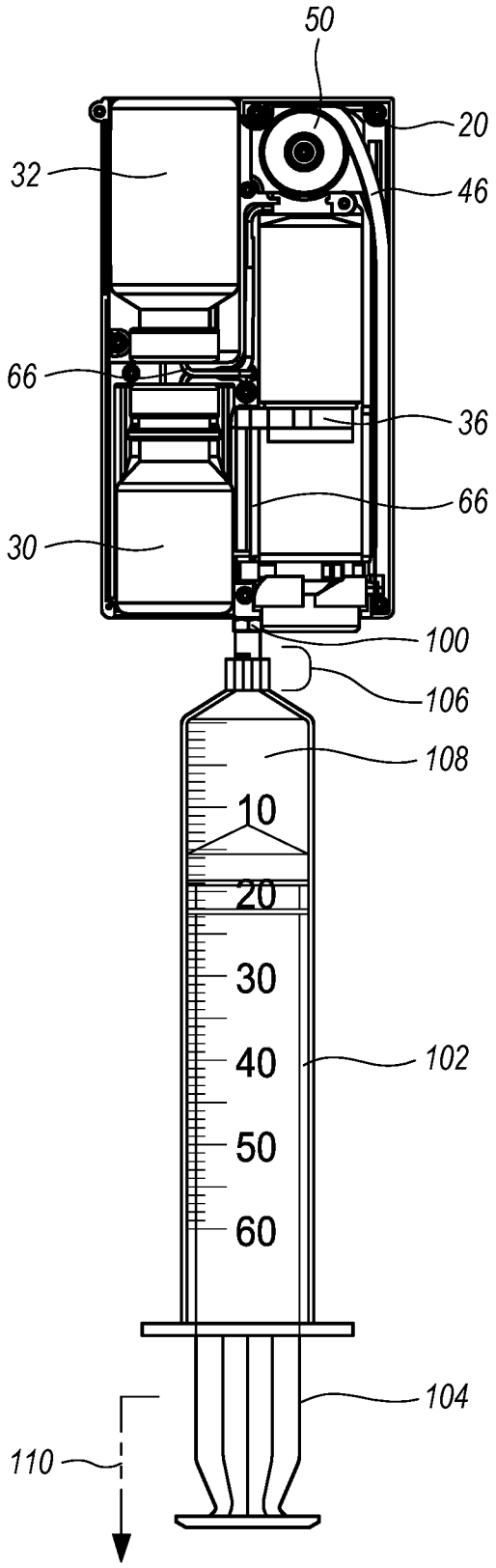
Figure 4J:
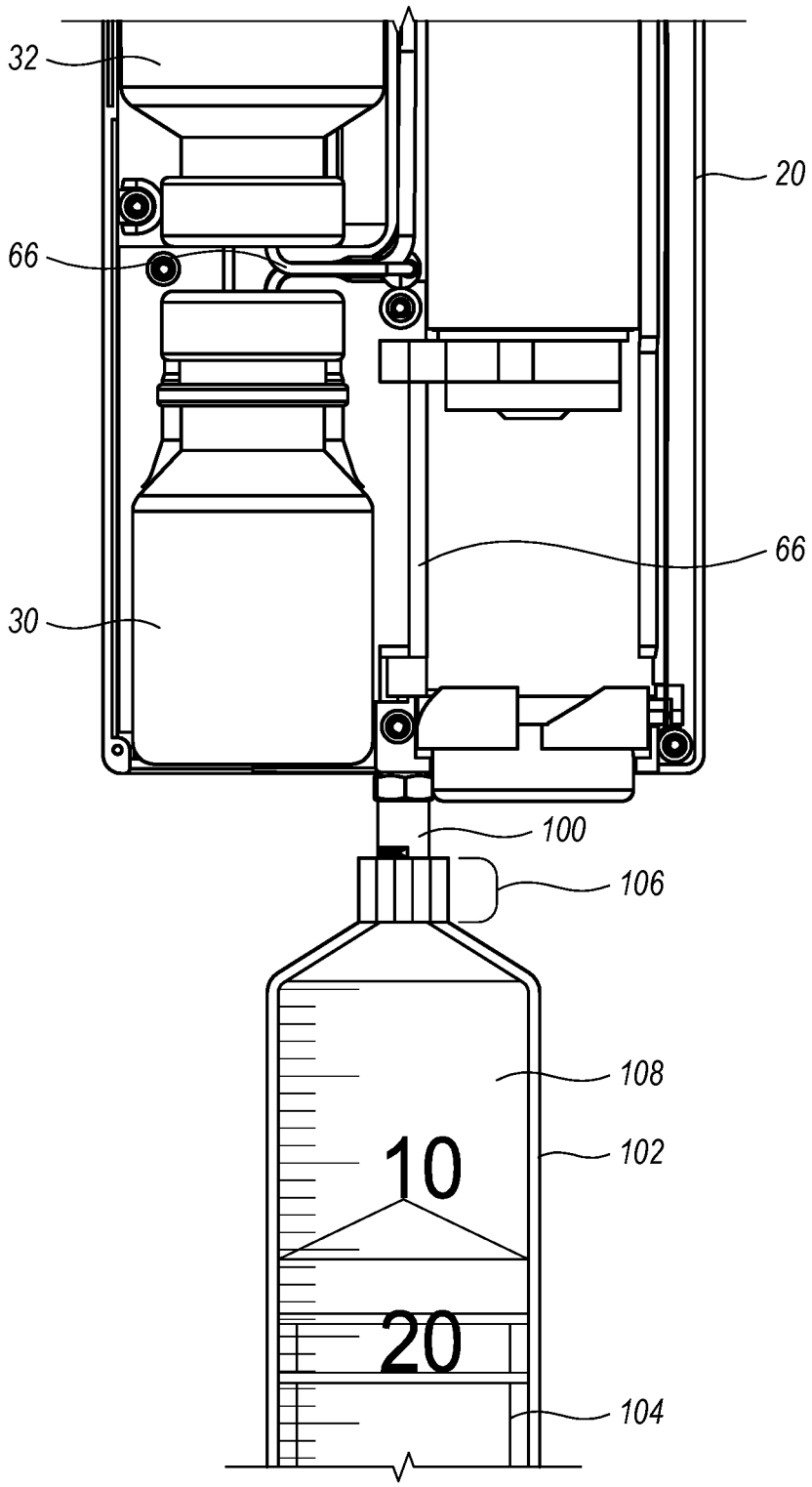

Referring to FIG. 4B, liquid drug component and powdered drug component containers (30, 32, respectively) are shown being inserted (88, 90, respectively) into the mixing assembly; upon full insertion and coupling therein, sharpened ends (68, as shown more clearly in FIG. 4A) of a transfer pipe (64) are configured to pierce each of the septums (84, 86, respectively) of these containers (30, 32) such that the containers become fluidly coupled by virtue of the transfer pipe (64). Alternatively, the sharpened end of the transfer pipe (68) may be configured to dispense the liquid component into the powdered drug component container (32) through a liquid diffuser to gently introduce the liquid to the powdered medicine, minimizing turbulence during mixing. The transfer pipe (64) may also contain a one way fluid flow valve, which allows liquid to flow into the powdered drug component container (32), but does not allow drug to flow back into the liquid drug component container (30). FIG. 4C illustrates these containers (30, 32) coupled into the mixing assembly and fluidly coupled with each other. Referring to FIG. 4D, the lockout interface (26) has been pulled (92), which frees the load transfer member (36) to be movable, as described above. Referring to FIG. 4E, with depression or compressive loading (94) at the top surface (56) of the actuation interface member (28), the load transfer member (36) is rotated (96), placing the load transfer member (36) protrusion previously preventing vertical displacement in alignment with a slot (60), which allows for vertical displacement of the load transfer member (36) and operatively coupled plunger member (38). With this new freedom of motion, the potential energy stored in the constant force spring (46) causes the plunger member (38) and associated plunger seal (44) to move downward into the cylindrical member (40), causing the gas, air, or other fluid contained therein to be expelled out, through a coupling pipe (62), into the liquid drug component container (30), with which the coupling pipe (62) is fluidly coupled (see FIG. 4A). FIG. 4F illustrates the plunger member (38) and plunger seal (44) fully seated at the bottom of the cylindrical member (40) after the spring member (46) has caused such relative displacement to maximally evacuate the previously contained volume of gas, air, or other fluid out of the volume (42) defined by the cylindrical member (40) and into the coupling pipe (62) and at least partially into the liquid drug component container (30). With the liquid drug component container (30) fluidly coupled to the powdered drug component container (32) by virtue of the transfer pipe (64), a volume of the liquid component is transferred through the transfer pipe (64) into the powdered drug component container (32). Thus a volume of combined components (i.e., liquid from the liquid drug component container (30) and powered drug component residing in the powdered drug component container (32)) are present within the same container (32) and may be gently mixed to form a prepared liquid drug, such as by gently manually moving by manually-applied oscillatory motion, the mixing assembly (shown, for example, in FIG. 4G). Referring to FIGS. 4H-4J, with the prepared liquid drug ready to be utilized and safely and conveniently contained within the powdered drug component container (32) that is housed within the easily-manipulated mixing assembly (such as is shown in FIG. 4G; note the window formed through the outer housing assembly in FIG. 4G to allow for direct visualization of the powdered drug component container (32) containing the prepared liquid drug), a syringe assembly comprising a syringe body (102), a plunger (104), and a mechanical interface (106, such as a Luer interface matched to pair with the exit interface (100) of the mixing assembly) may be removably coupled to the mixing assembly such that the plunger (104) may be withdrawn (110) relative to the syringe body (102) with the assembly oriented to place the powdered drug component container (32) in a gravity-up/exit-down orientation, to obtain a given volume (108) of prepared liquid medicine from the powdered drug component container (32), through the exit pipe (66) which fluidly couples the powdered drug component container (32) to the exit interface (100) (see FIG. 4A), and ultimately within the syringe body (102) to be ready for injection into a patient. The exit interface (100) may also contain a one way valve to allow the prepared liquid drug to be transferred to the syringe body (102), and prevent the accidental expulsion of air from the syringe body into the powdered drug component container (32). Expulsion of air from the syringe into the powdered drug component container (32) may cause entrapment of prepared liquid drug into and through the transfer pipe (64), and into the liquid drug component container (30). The prevention of the expulsion of air into the powdered drug component container (32) may prevent loss of prepared liquid drug. FIGS. 4I and 4J illustrate partially cutaway and close-up views to further illustrate inner components of the configuration of FIG. 4H.

Referring to FIG. 5 and FIGS. 6A-6C, another embodiment is depicted having many similar components and functionalities as described above, with the exception that the assembly does not feature a stored source of potential energy to automatically insert the plunger member (such as element 38 in FIG. 4A) relative to the cylindrical member (such as element 40 in FIG. 4A) to conduct the component combination; rather, a window (134) is formed in the outer housing assembly (132) to facilitate manual depression of the exposed plunger or insertion member (138), as shown in FIG. 6A. FIGS. 6B and 6C illustrate partially exploded views to show the different outer housing assembly (132) and inner housing assembly (136), along with the exposed "manual insertion" plunger member (138) as it is exposed to the user through the window (134) formed in the outer housing assembly (132). Thus in a manually-energized version of a process such as that illustrated in FIG. 5, a container of liquid component, container of powdered drug component, an empty syringe, needle, and manually-energized mixing assembly are provisioned (120). The liquid and powdered drug component containers are coupled into the mixing assembly, thereby piercing each container's septum and fluidly coupling the containers to each other with a transfer pipe (122). When an operator desires mixing the components, a safety mechanism may be manipulated and a mixing actuation interface, such as the top surface of the manually driven plunger member, may be depressed and inserted to manually cause air or other gas or fluid to be compressed into the liquid component container, thereby causing a given volume of liquid component contained therein to be displaced into the powdered drug component container (124). The entire assembly may be moved (such as by gentle manually applied oscillatory motion) to mix the combined liquid and powdered drug components within the powdered drug component container, forming a prepared liquid drug (126). A syringe body may be removably coupled to an exit interface or "prepared liquid drug interface", such as a Luer interface, of the mixing assembly, the mixing assembly may be tipped gravity-up/exit-down, and the plunger associated with the syringe retracted to intake prepared liquid drug into the syringe (128). The needle may then be fastened to the syringe body, and the filled syringe assembly may be utilized to administer prepared liquid drug to a patient.

Figure 7A:
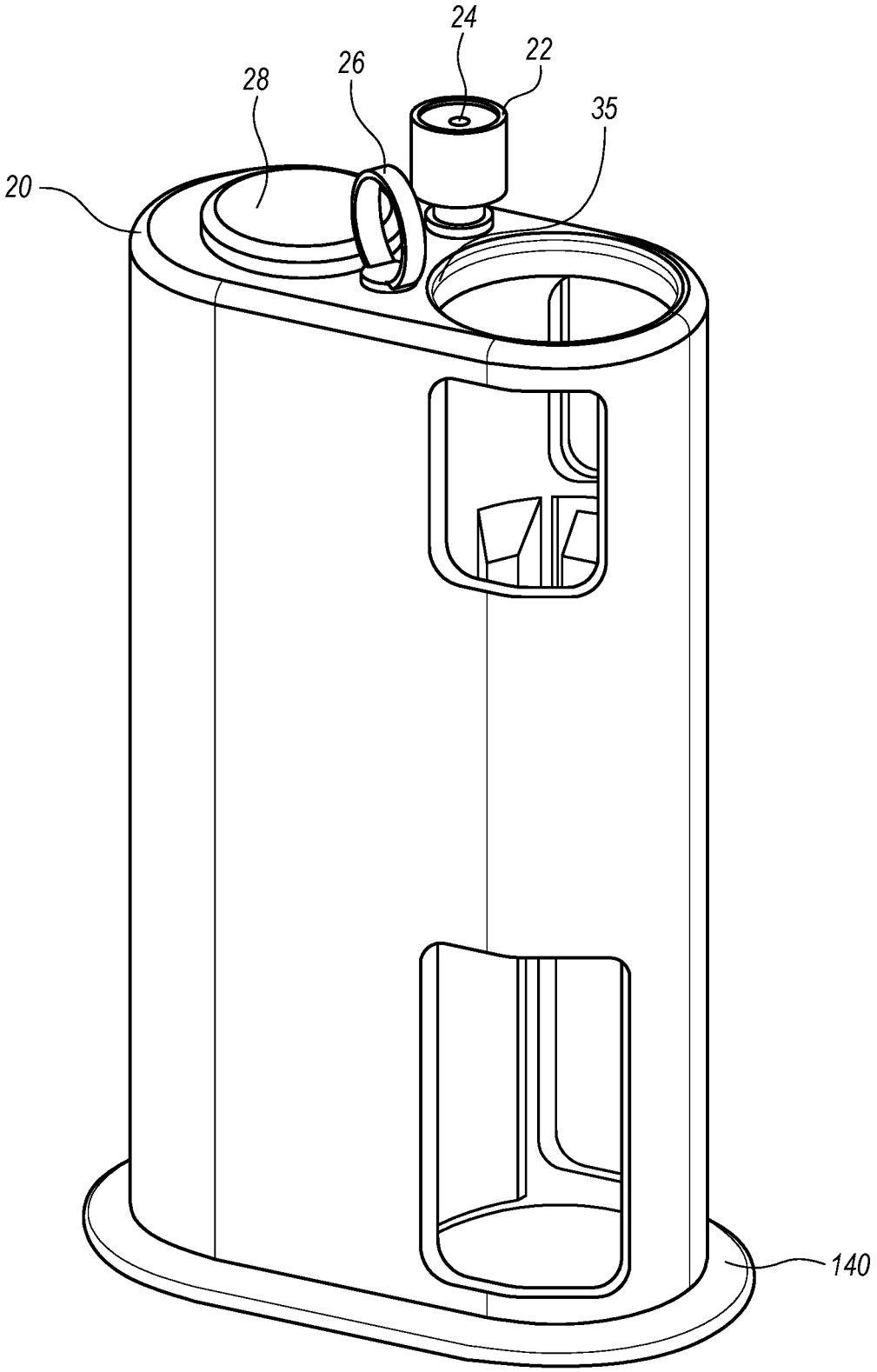
Figure 7B:
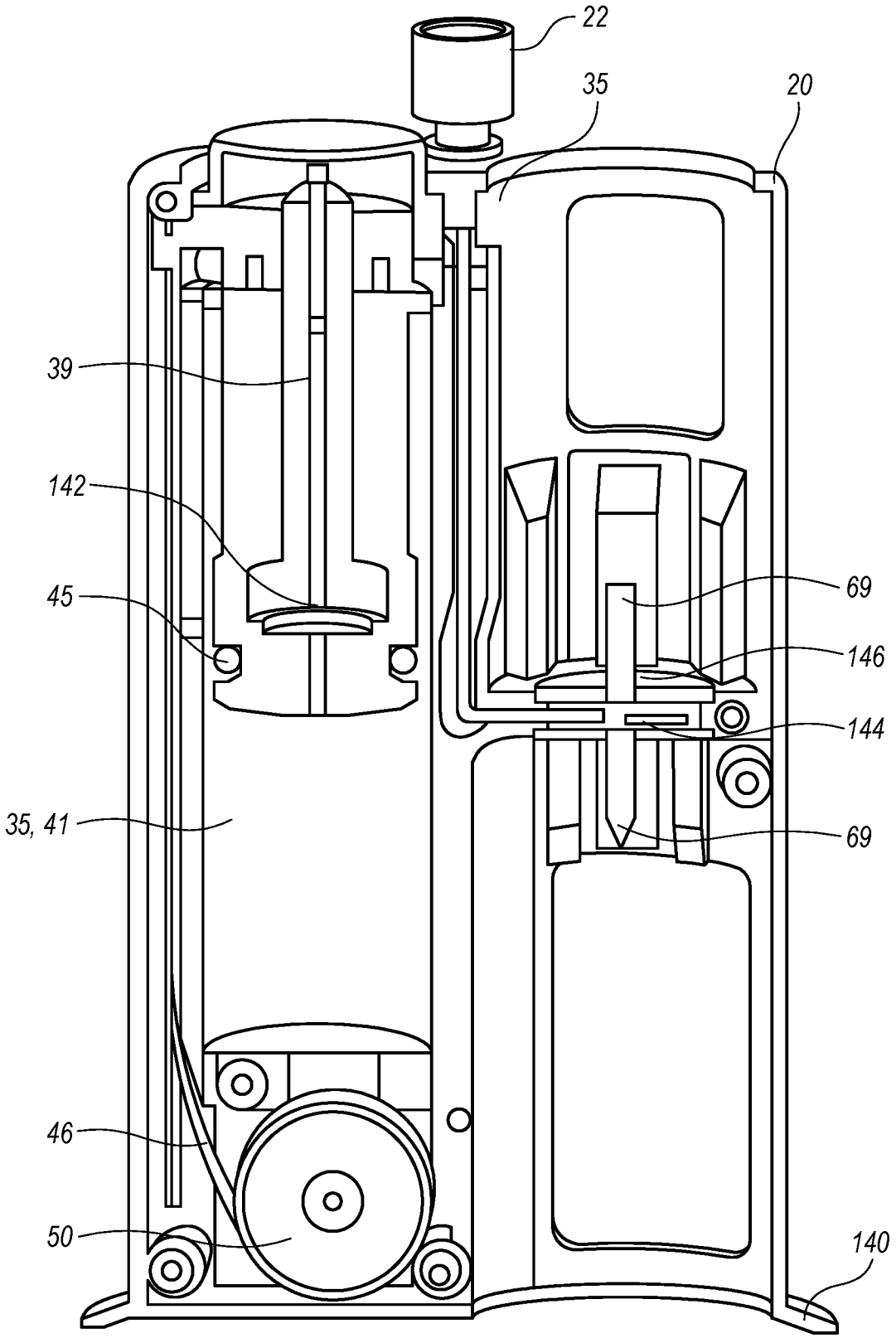
Figure 7C:
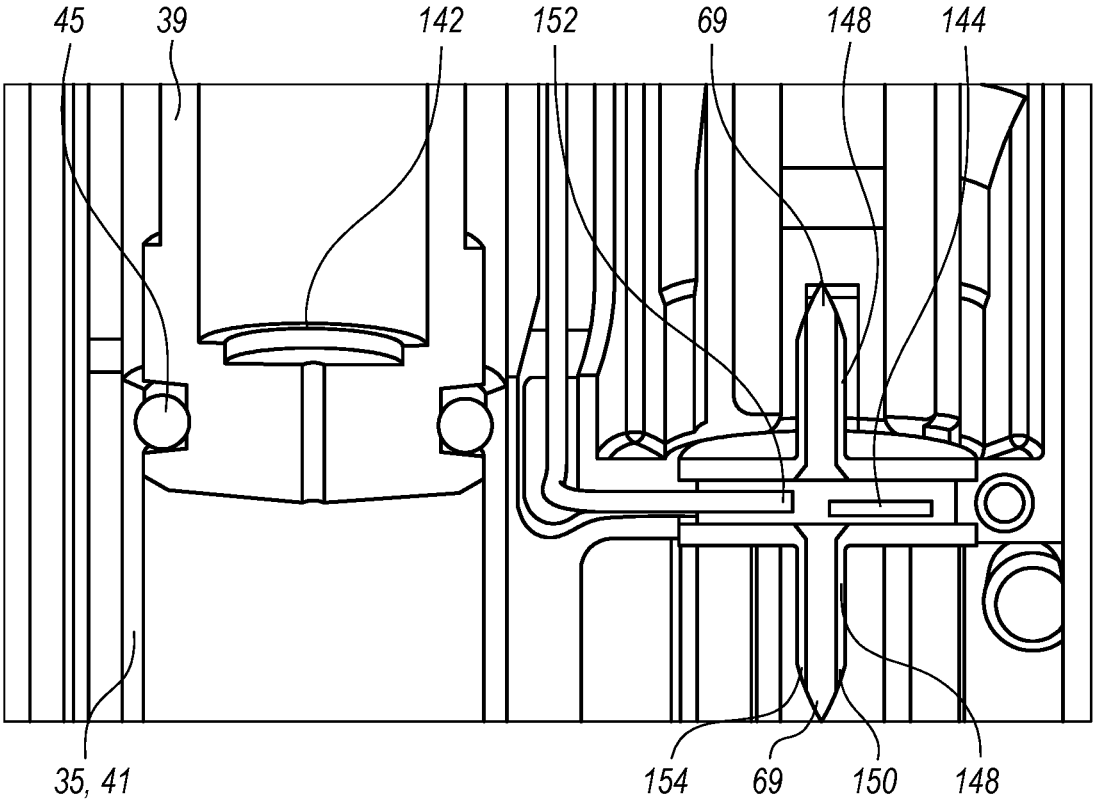
Figure 7D:
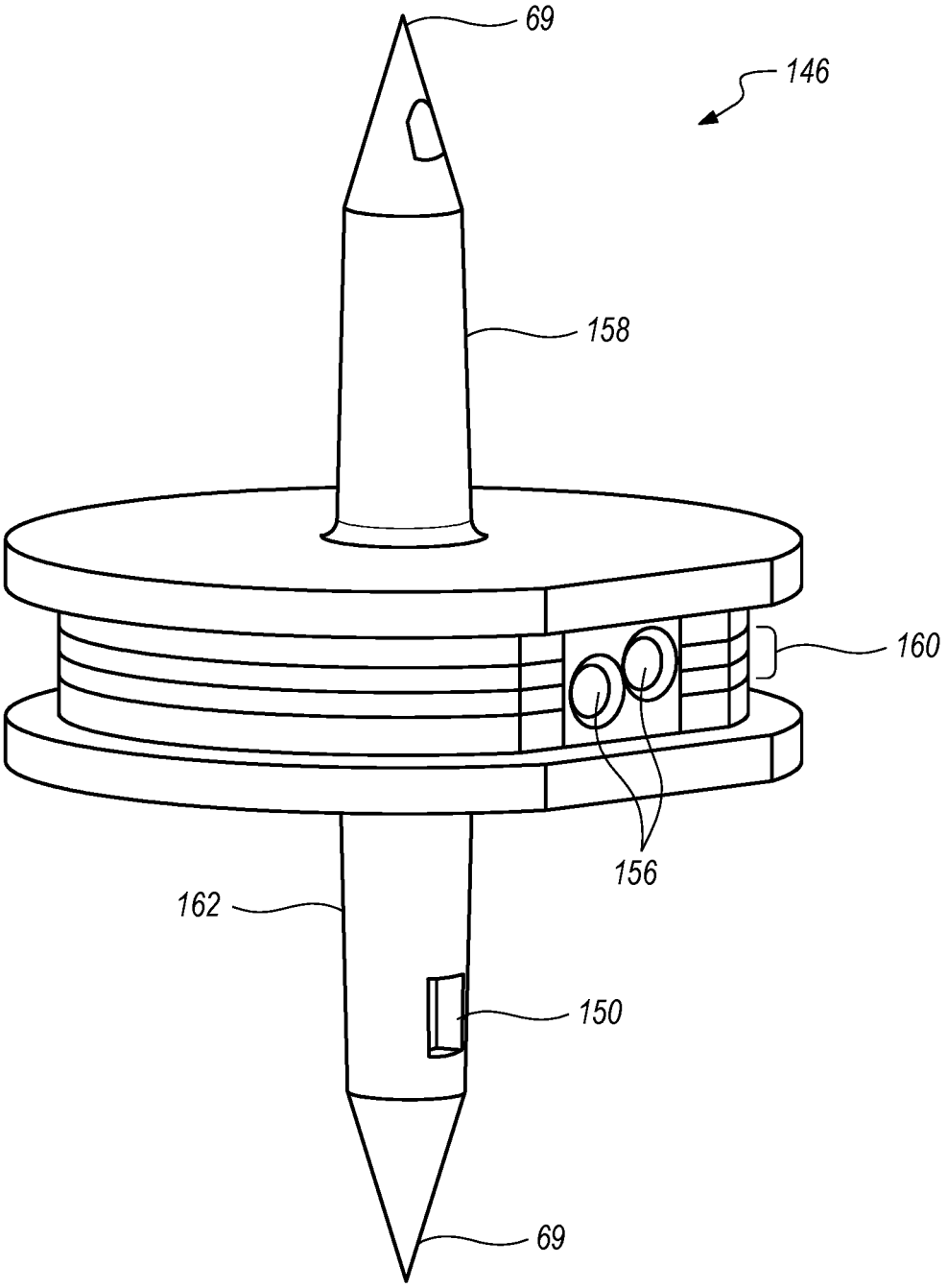
Figure 7E:
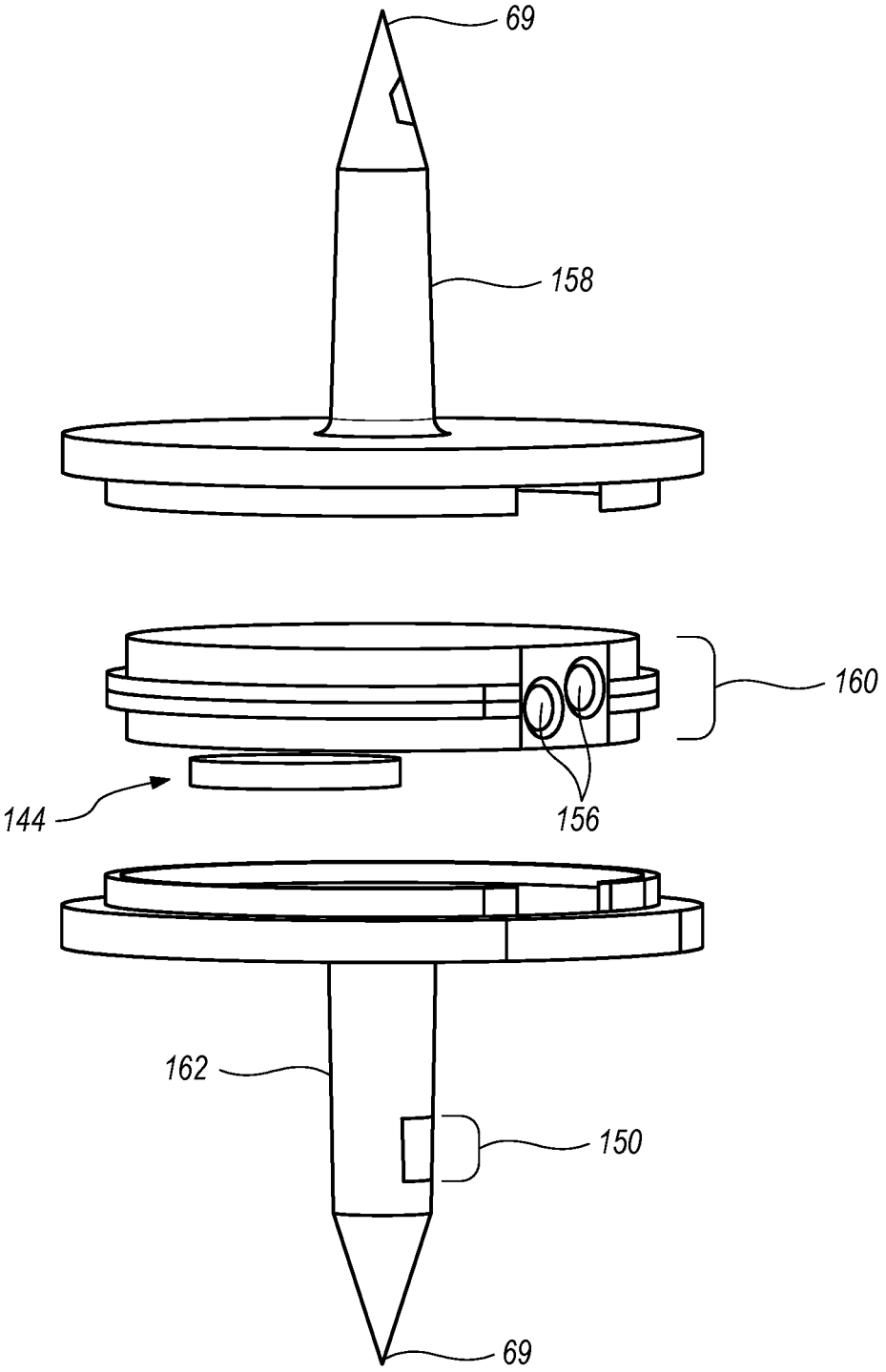
Figure 7F:
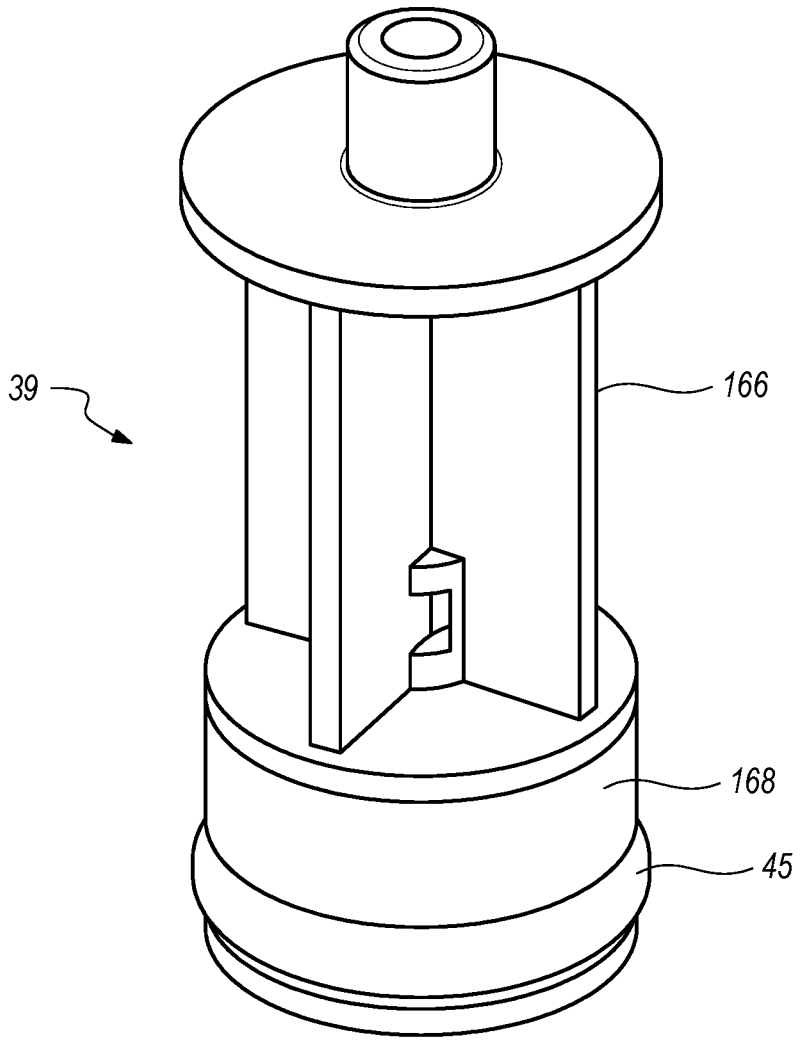
Figure 7G:
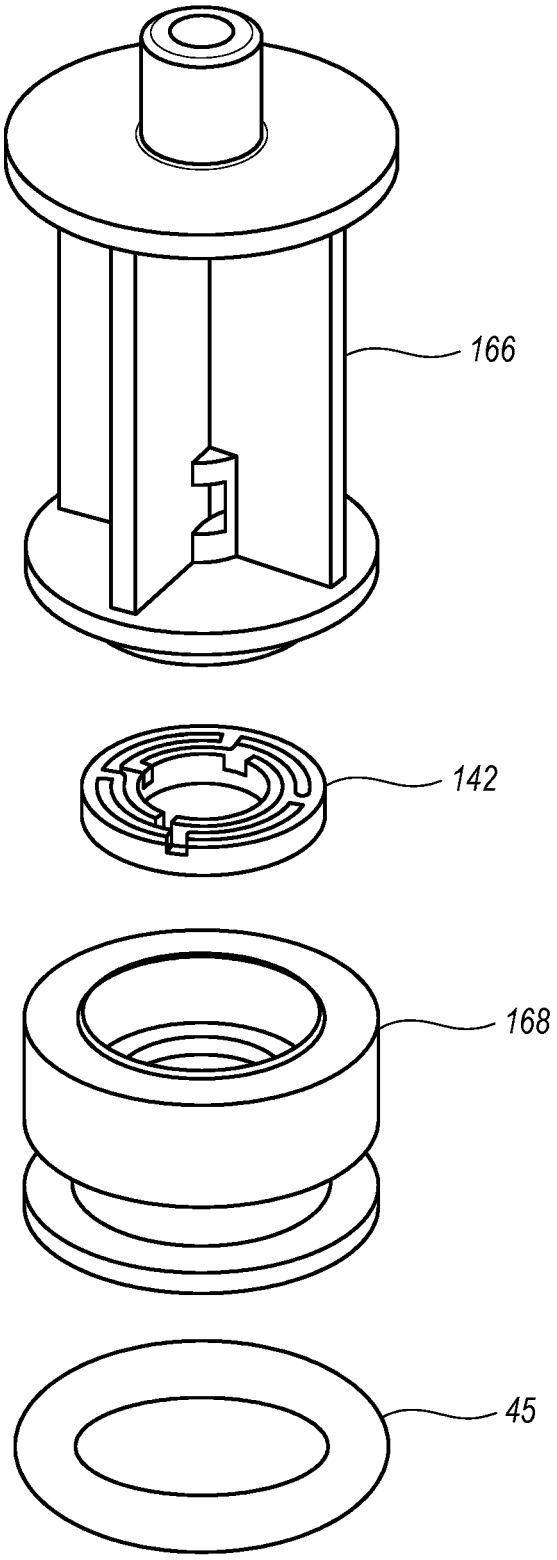

Referring to FIGS. 7A-7G, aspects of embodiments similar to those illustrated in FIGS. 4A-4J are shown, with the configurations of FIGS. 7A-7G having some differences from those of FIGS. 4A-4J. For example, referring to FIGS. 7A and 7B, the inner housing assembly (35) has different geometry and comprises the cylinder member (41) which contains the volume of air or other gas to be pushed with the plunger member (39). The plunger member (39) in this embodiment has an integrated 1-way valve (142), and features an operatively coupled O-ring (45) as a seal for compressing the air or gas. Further the outer housing comprises a flanged geometry bottom (140) configured to be easily set upon a flat surface such as a table. The configuration of FIGS. 7A-7G also features transfer/exit assembly (146) which may be constructed of a polymeric material and have small functional features that may be formed, for example, using injection molding techniques. FIGS. 7B and 7C are cross sectional views; 7C illustrates a close-in cross sectional view to illustrate details of the transfer/exit assembly (146) and the 1-way valves (142, 144) positioned to facilitate only 1-way flow through the plunger assembly and transfer lumen (148) of the transfer/exit assembly (146). FIG. 7C shows the transfer lumen (148), flow through which is configured to be interrupted by the 1-way valve (144) to prevent backflow. The 1-way valve (144) in the plunger assembly (39) allows air to be drawn into the mixing assembly when the mixed drug is extracted through the exit coupling assembly (22). If there is no way to allow air into the mixing assembly, the mixed drug cannot be extracted due to the vacuum lock phenomenon. The exit geometry (150) of the transfer lumen (148) is configured to sprinkle fluid at a gentle angle into the associated powdered drug component container (32), while the entrance geometry (154) of the exit lumen (152), which is fluidly coupled with the exit pipe and exit coupling assembly (22) is configured to be relatively large and positioned to be able to extract substantially all of the mixed fluid from the associated powdered drug component container (32). FIG. 7D illustrates a transfer/exit assembly with sharpened tips (69) for piercing container seals, a top portion (158), bottom portion (162), middle portion (160) featuring air-gas/exit portal interfaces (156), and, as shown in the exploded view of FIG. 7E, the intercoupled 1-way valve (144) configuration. FIG. 7F illustrates a plunger assembly (39) featuring a top portion (166), bottom portion (168), and intercoupled o-ring (45) and 1-way valve (142), as further illustrated in the exploded view of FIG. 7G.

Figure 8A:
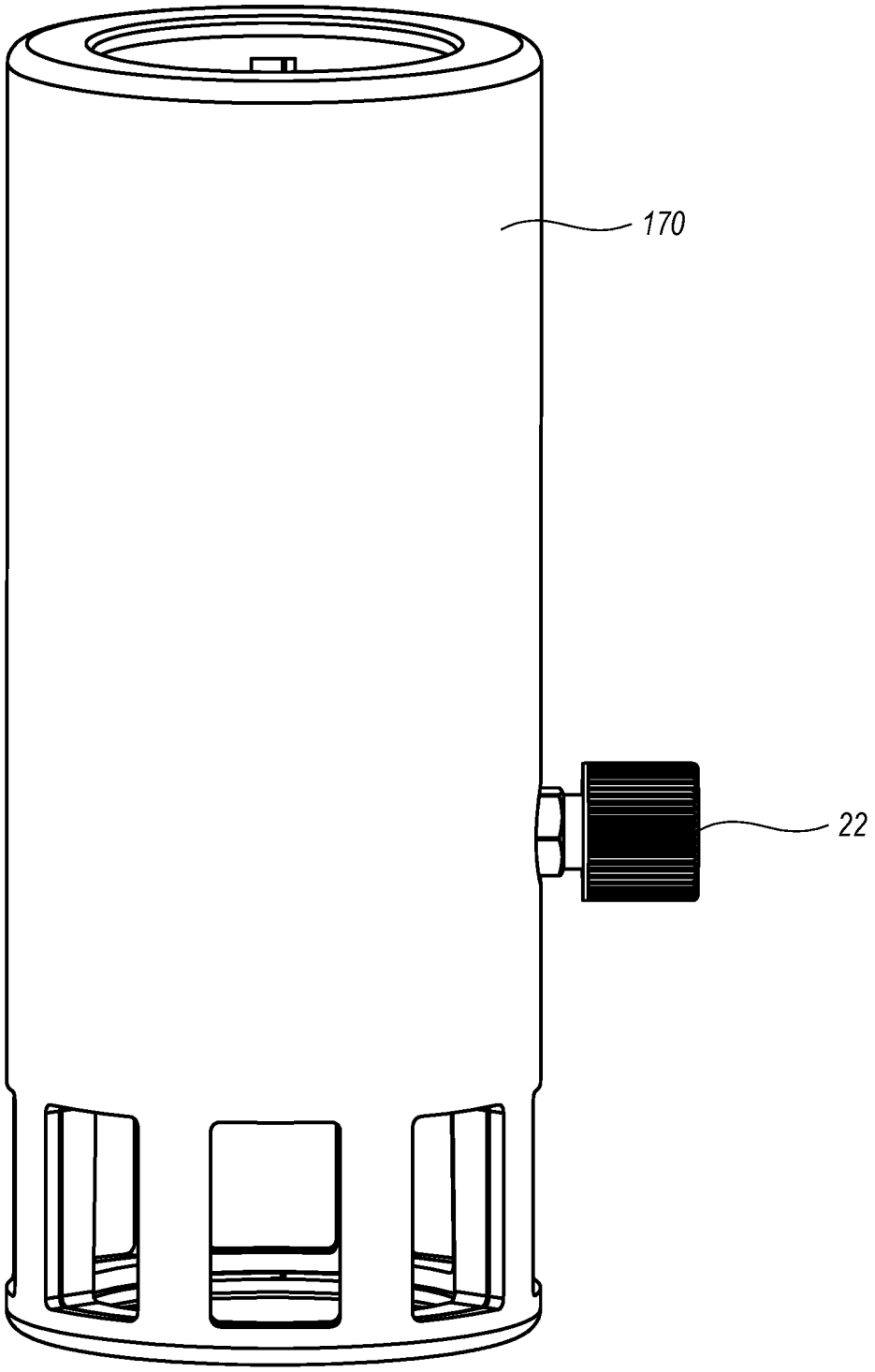
Figure 8B:
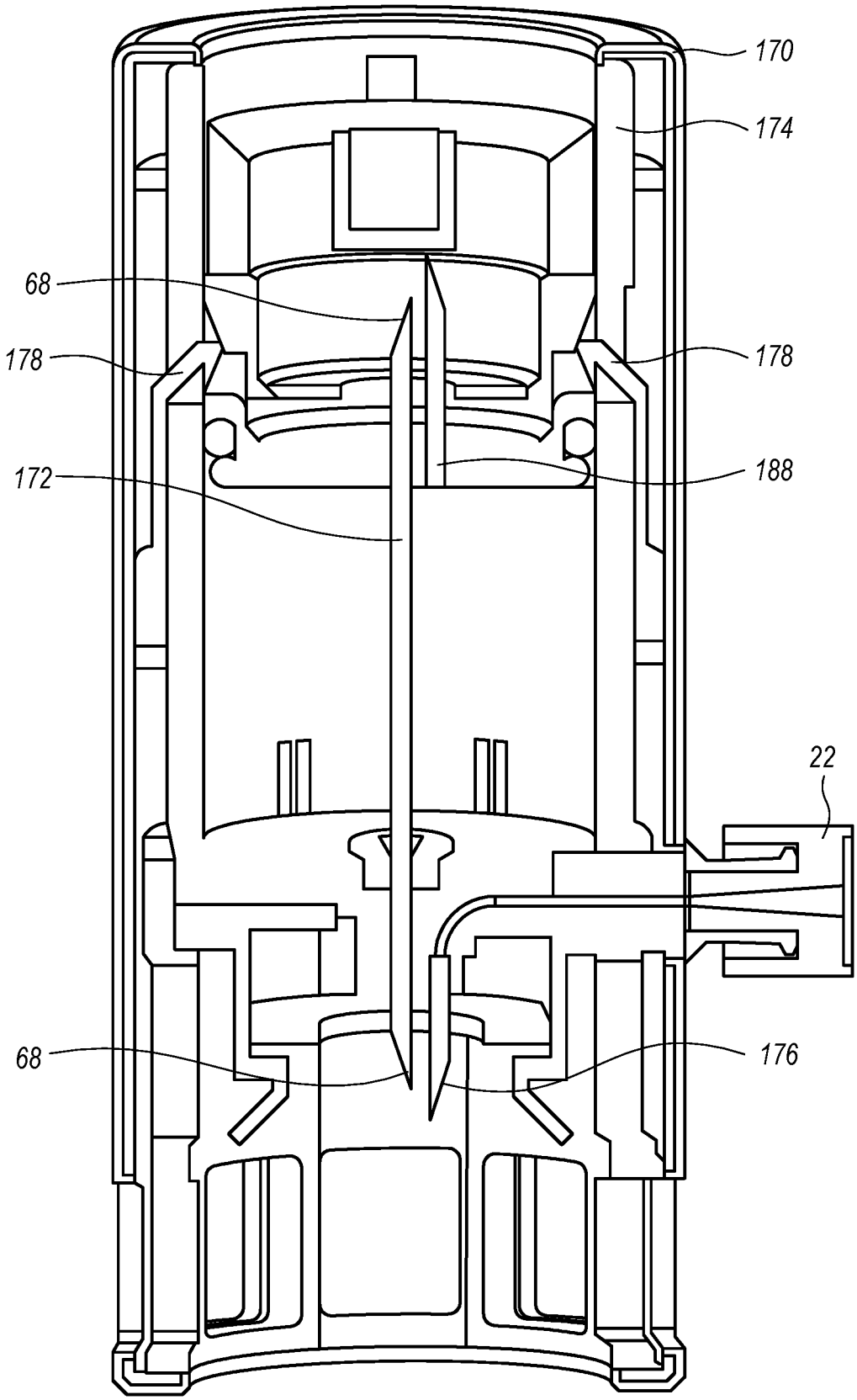
Figure 8C:
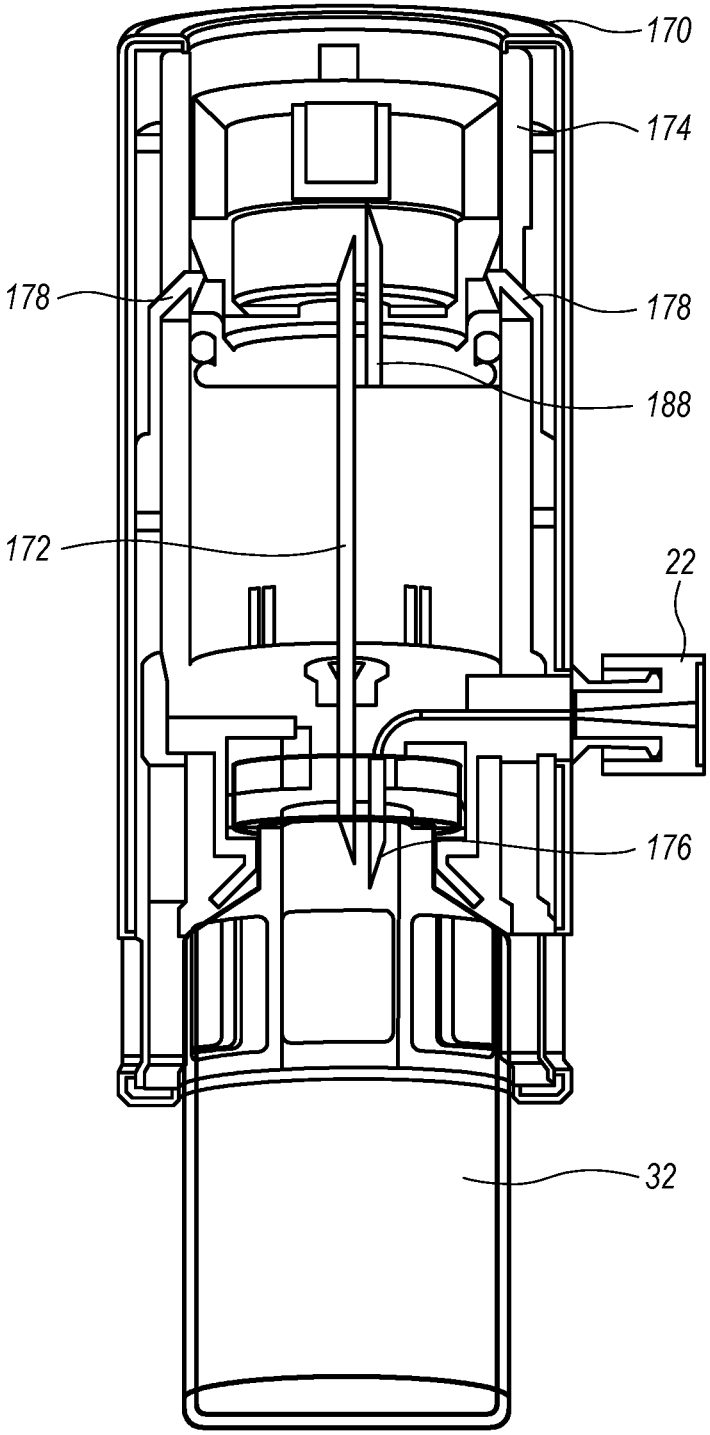
Figure 8D:
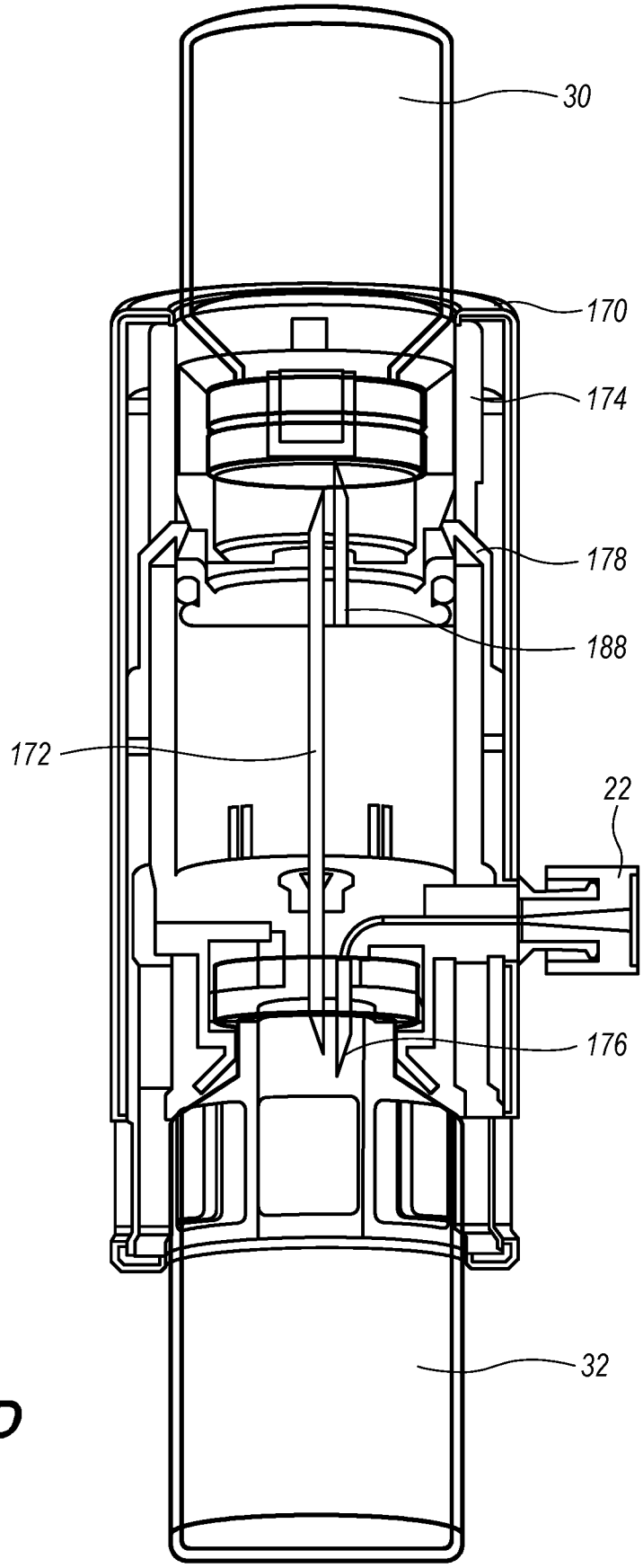
Figure 8E:
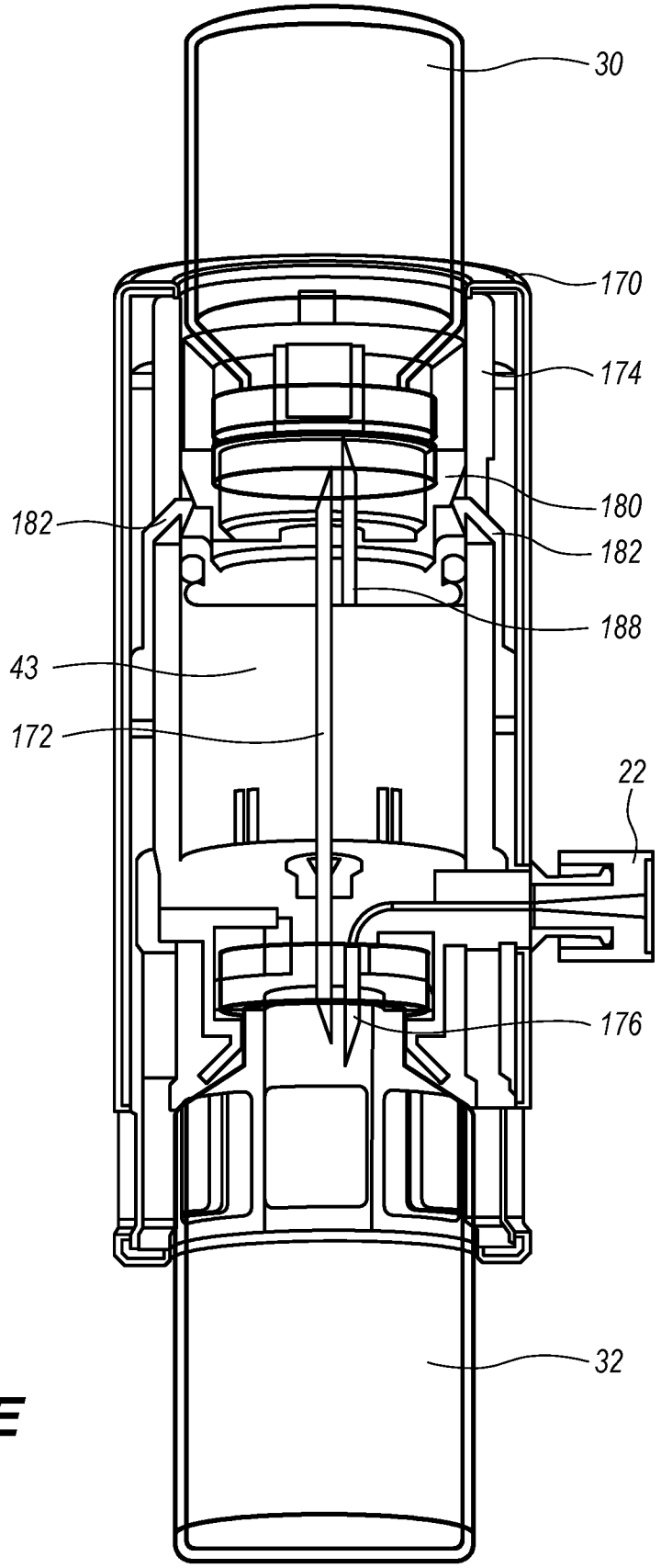
Figure 8F:
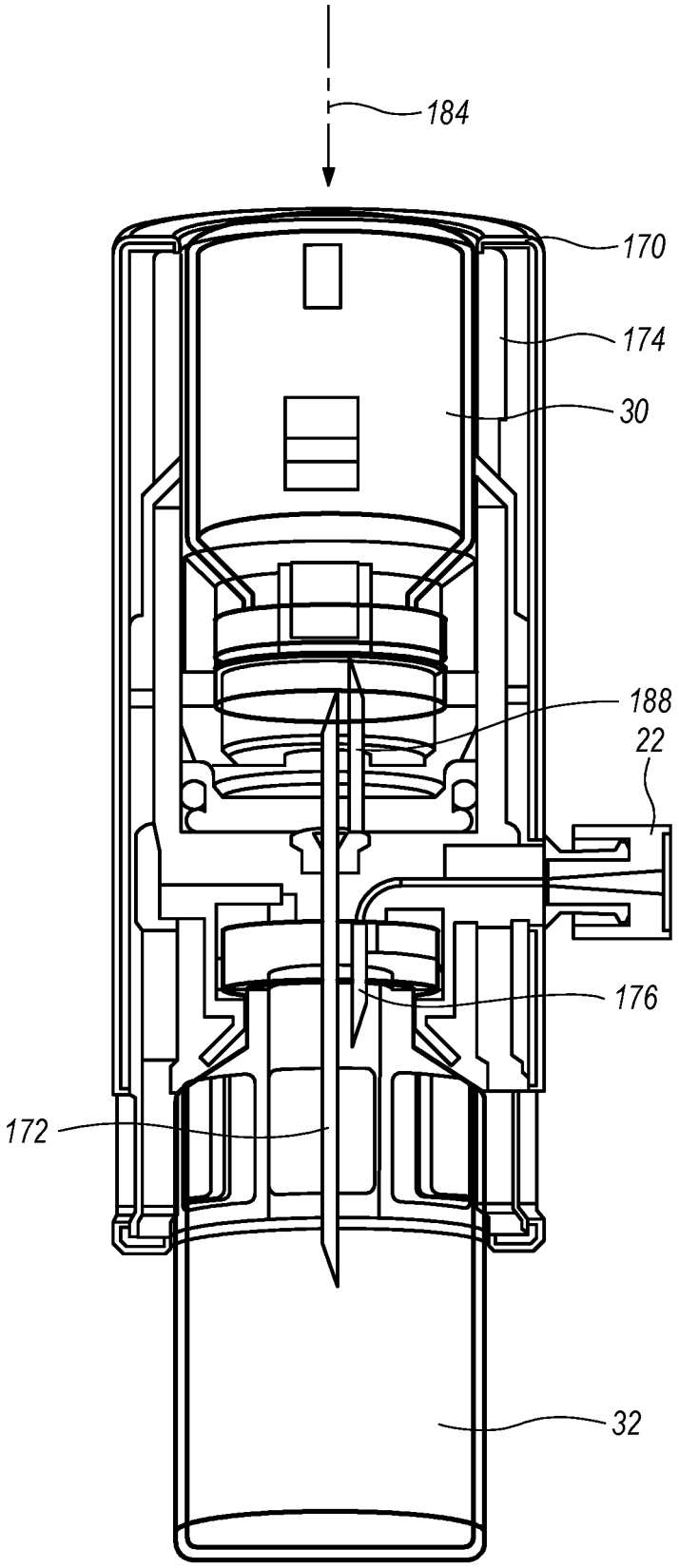
Figure 8G:
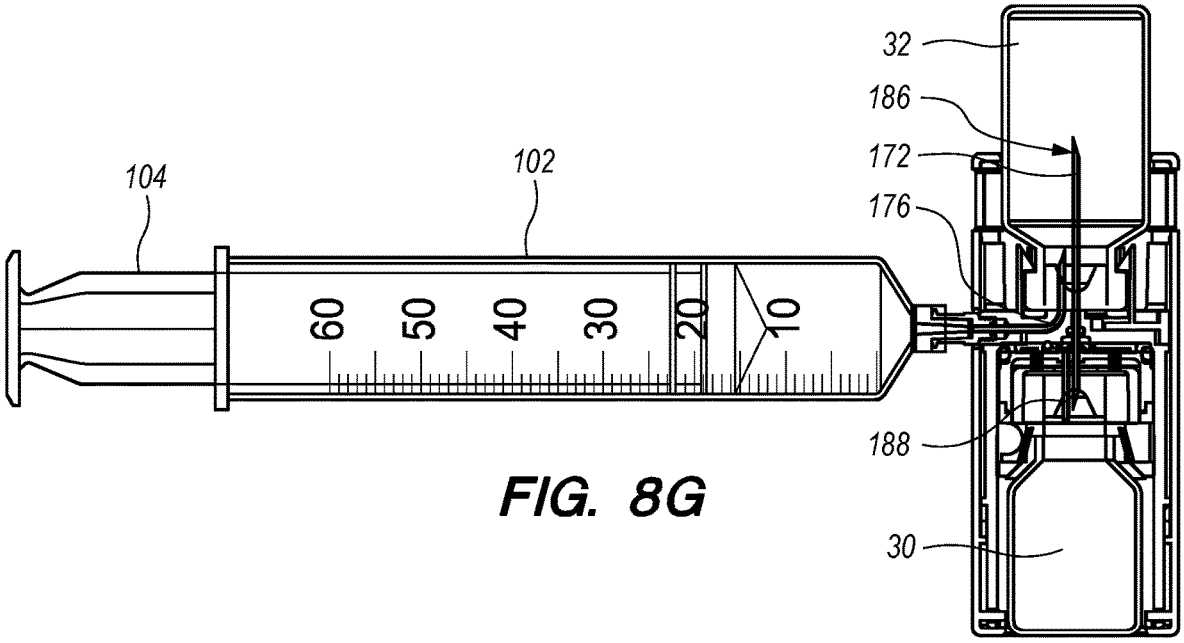

Referring to FIGS. 8A-8G, another mixing configuration is illustrated, wherein liquid drug component container (30) itself may be utilized as a plunger handle of sorts to effect mixing after appropriate assembly of componentry. FIG. 8A illustrates an outer housing (170) configuration. FIGS. 8B-8G illustrate cross sectional views. FIG. 8B illustrates a condition without any containers (30, 32) intercoupled. A transfer pipe (172) has sharpened ends (68) to pierce seals of containers (30, 32) when intercoupled. The exit pipe (176) is relatively short as it is intercoupled to the exit geometry interface (22). An inner housing assembly (174) intercouples componentry to facilitate coupling of the powdered drug component container (32) as shown in FIG. 8C. Upon full insertion of the powdered drug component container (32), as shown in FIG. 8D, a portion of the inner housing assembly (174) is configured to push two latch members (178; see FIG. 10A) outward to facilitate insertion of the other ("liquid") drug component container (30), as shown in FIG. 8D. FIG. 8E illustrates a configuration with the top drug component container (30) fully seated—and a collar member (180) operatively coupled to the fully-seated top drug component container (30) is configured to push outward two other latch members (182) such that the top drug component container (30) may be inserted relative to the outer housing (170), which causes air or gas from the contained volume (43) to be compressed through the transfer tube (188) into the top drug component container (30), thereby causing the contents thereof to be compressed through the transfer pipe (172) and into the powdered drug component container (32). In other words, in FIG. 8F, the top drug component container (30) is being pushed (184) like a plunger handle to cause the mixing, only after the abovementioned sequence of events, with lockouts using the latch members (178, 182) to prevent different orders of events. FIG. 8G illustrates using a syringe body (102) and syringe plunger (104) to extract the prepared liquid drug for use. The tip (186) of the transfer tube may be configured to have a length just long enough to not accidentally transfer prepared liquid drug back to the other container (30) when in the gravitational orientation shown in FIG. 8G (i.e., with the powdered drug component container (32) gravity-up/exit-down). FIGS. 9A-B illustrate that a 1-way valve (190) may also be put in place to prevent backflow at the transfer tube (188) between the top drug component container (30) and the contained volume (43).

Figure 10A:
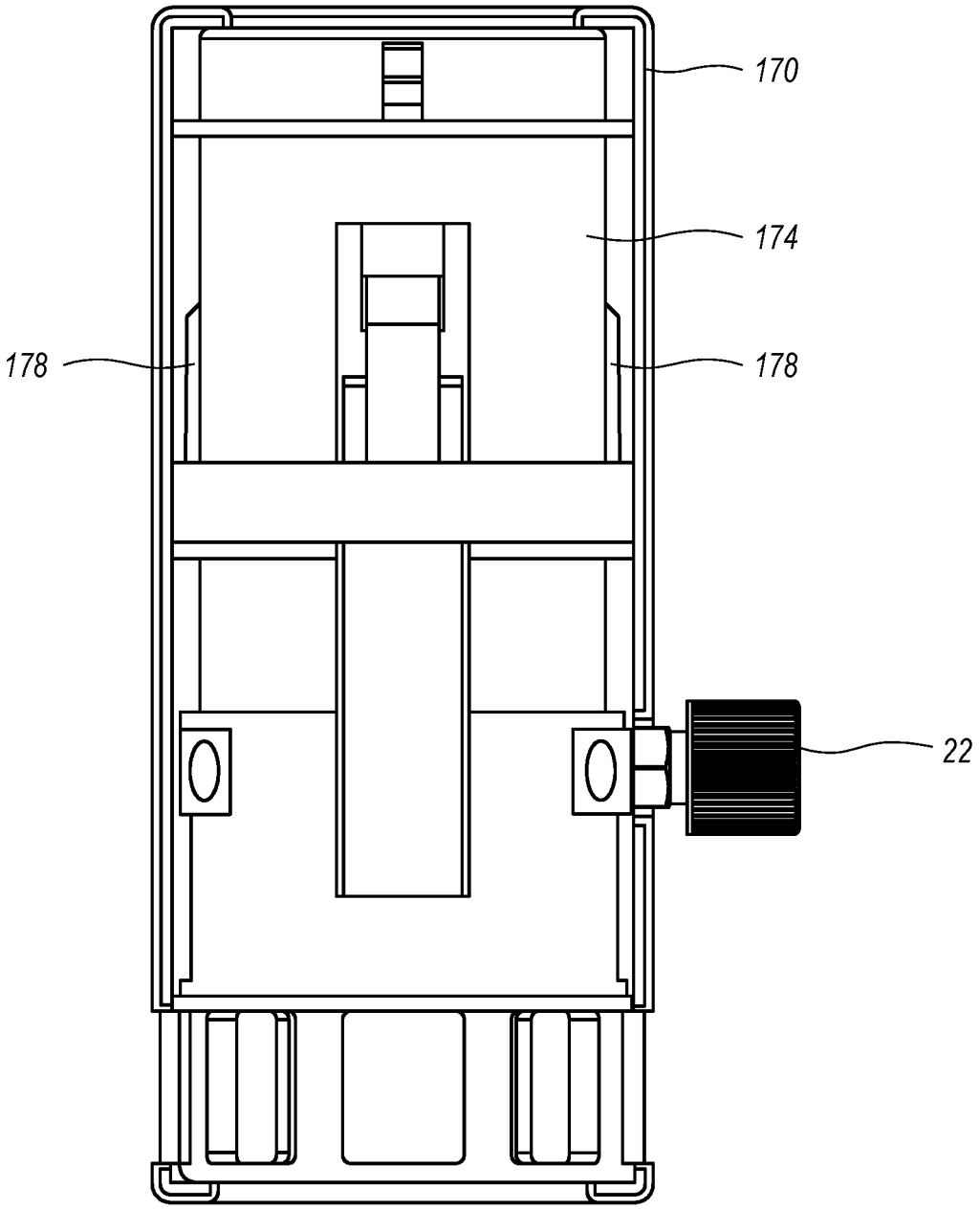
Figure 10B:
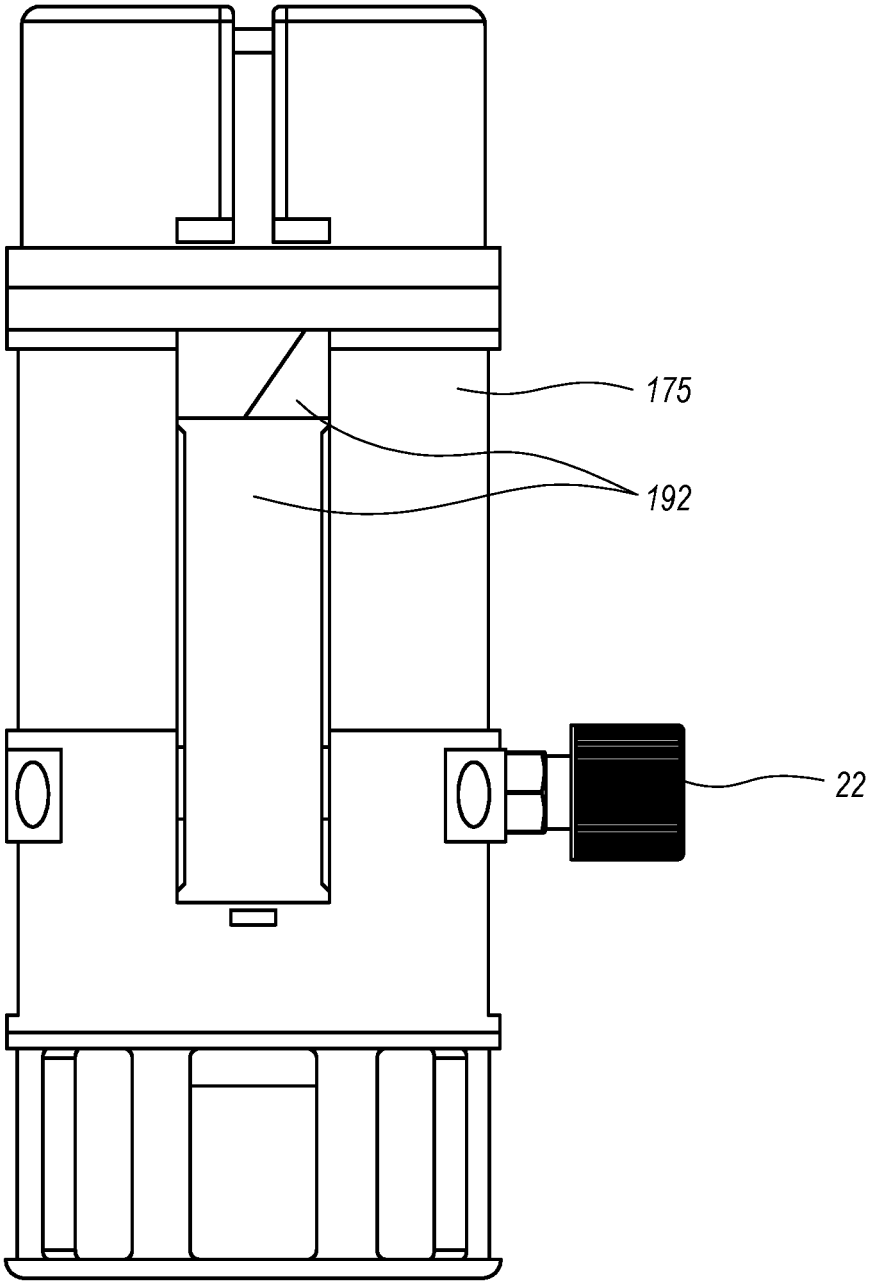
Figure 10C:
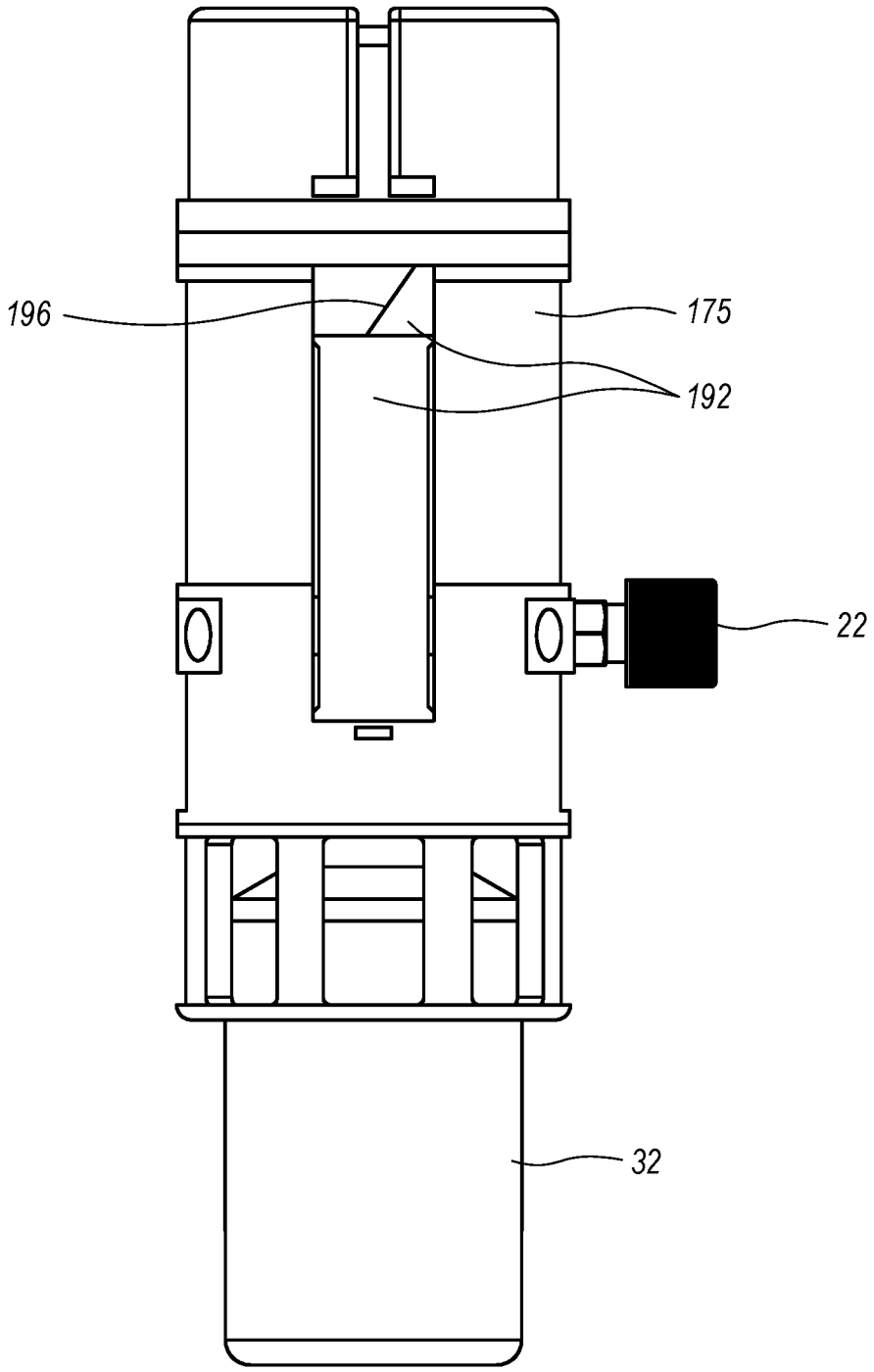
Figure 10D:
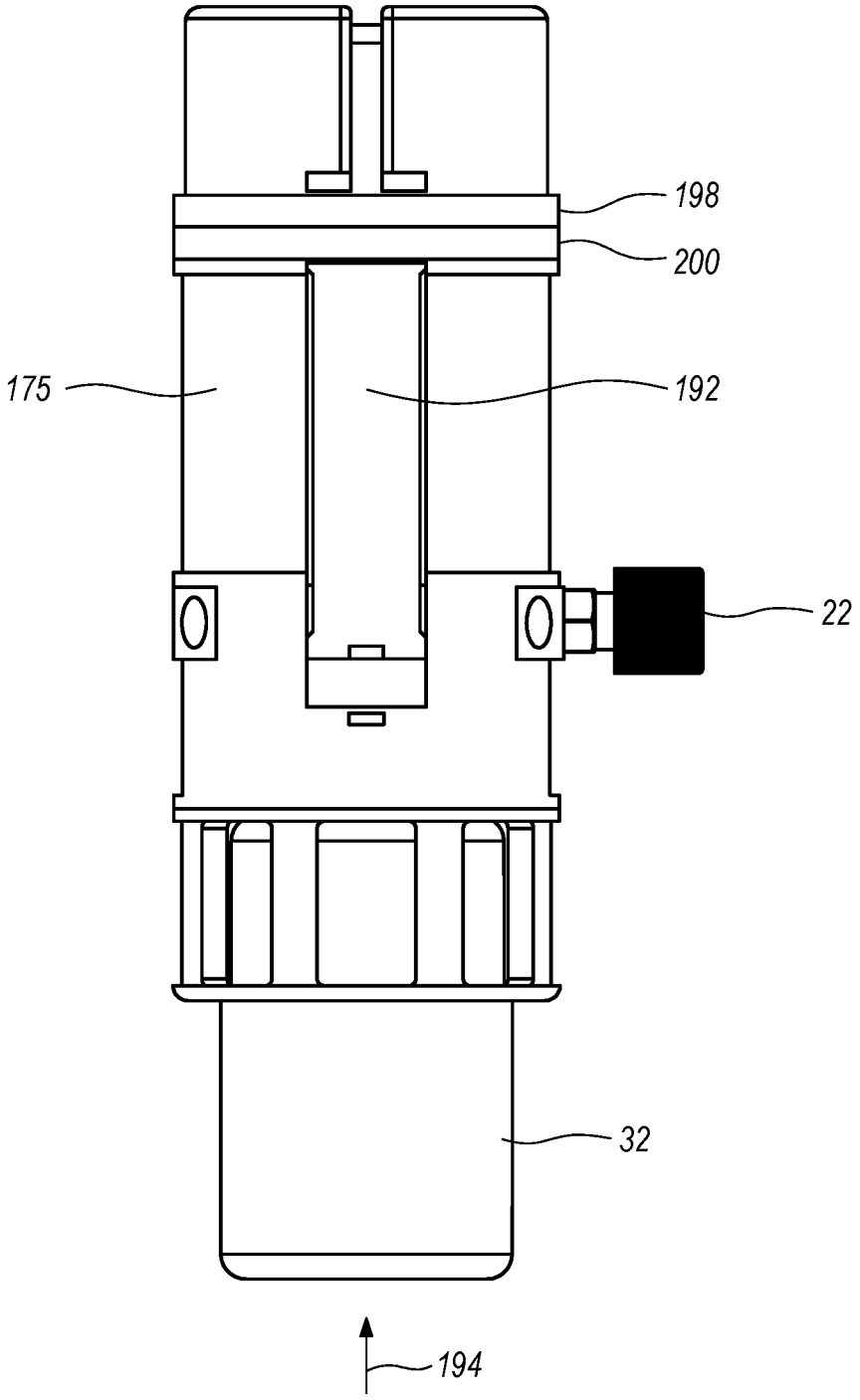
Figure 10E:
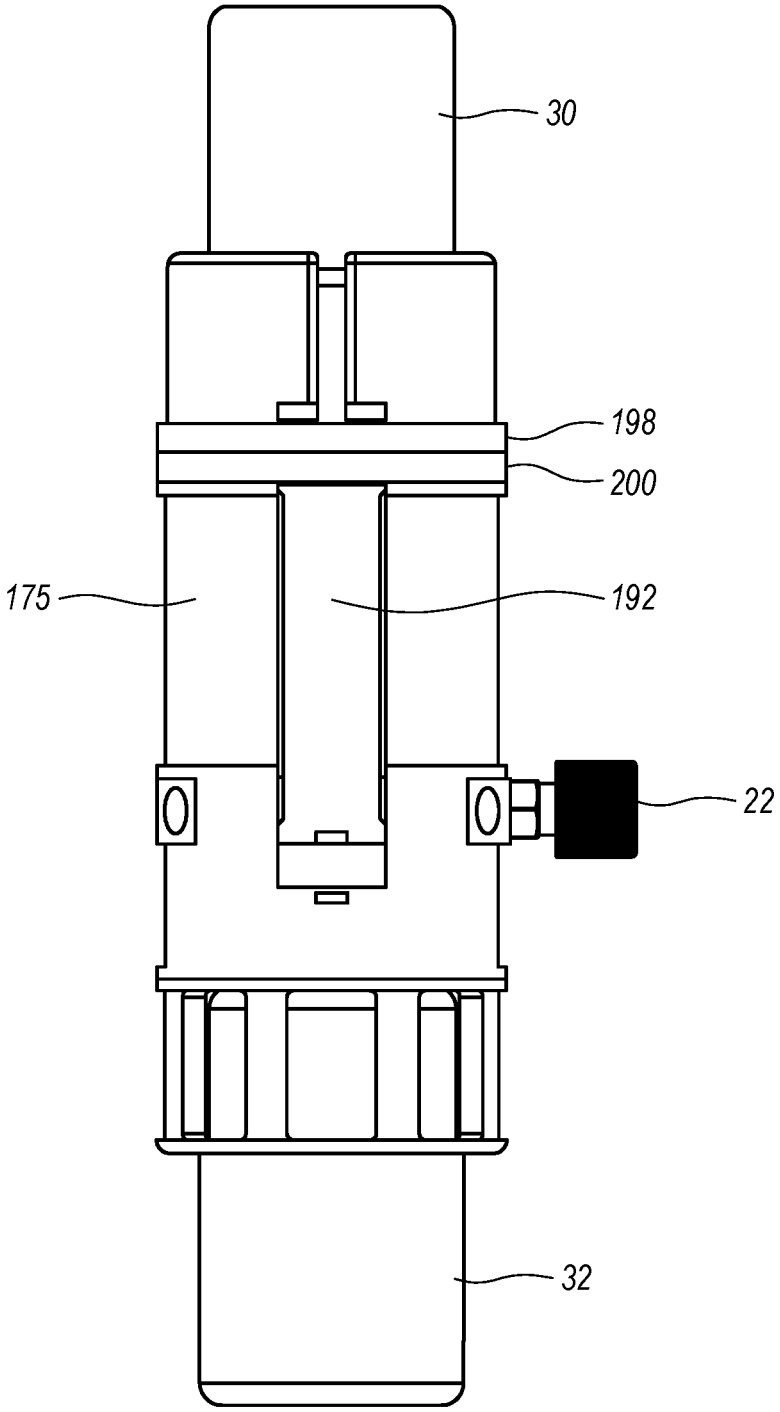
Figure 10F:
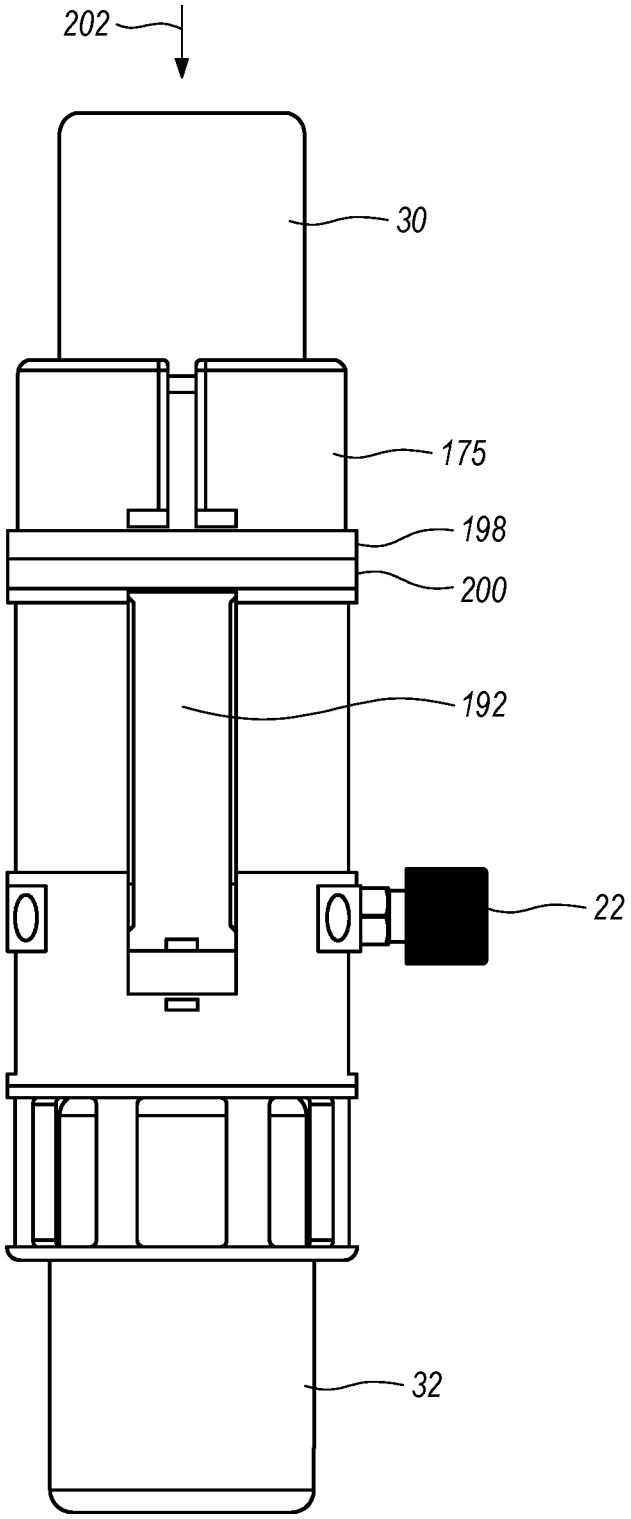
Figure 10G:
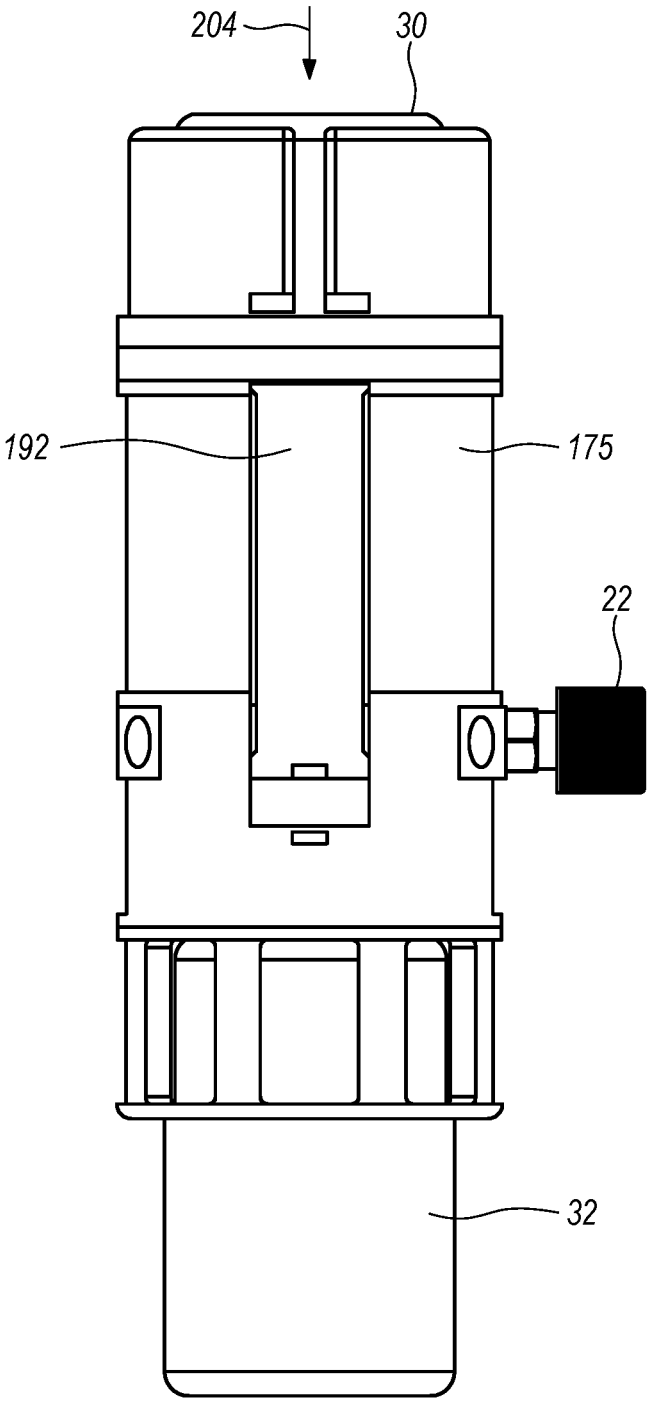
Figure 10H:
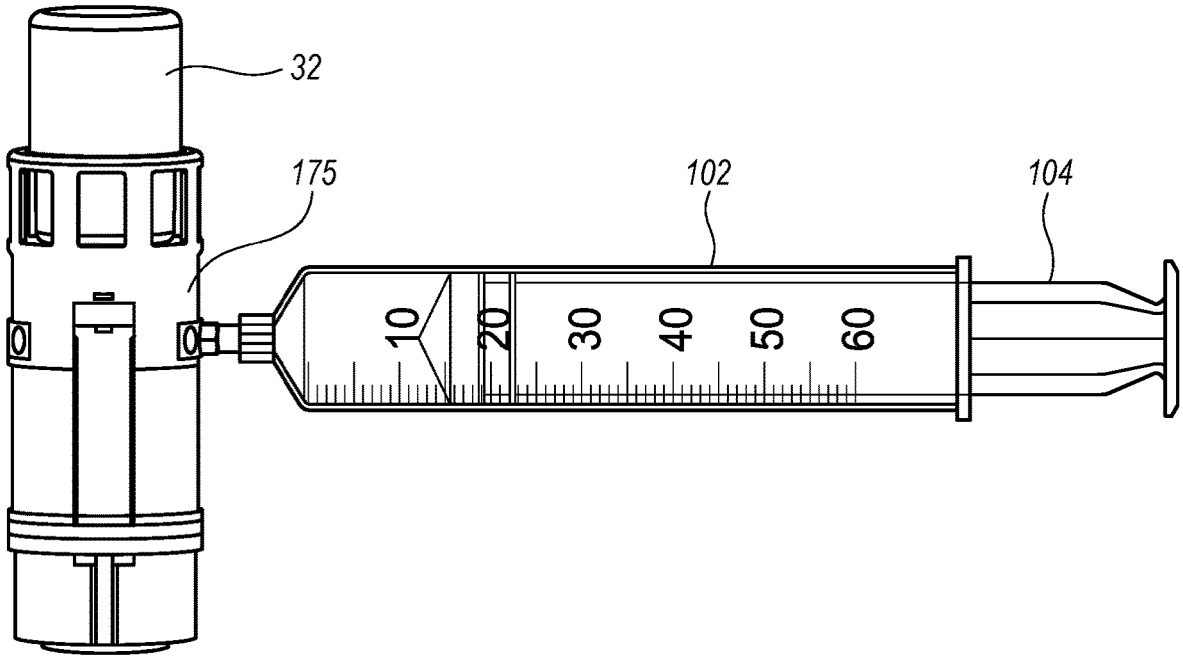

FIGS. 10B-10H illustrate a configuration similar to that of FIGS. 8A-8G, with the exception that rather than having the latch members (178, 182) constrain the order of events, a pair of ring members (198, 200) are configured to interface with movable components of the inner housing assembly (175) to rotate these ring members (198, 200) and appropriately constrain the event order. FIG. 10A is an orthogonal view of the configuration of FIGS. 8A-8G with the outer housing partially removed to show the positioning of the latch members (178) described above. FIGS. 10B-10H are illustrations with the outer housing removed to show that a latch member (192) with an angled portion (196) may be used to push engaging features on one or more of the ring members to rotate these ring members relative to the inner housing assembly (175) to restrict certain actions. FIG. 10B shows a mixing assembly without either container (30, 32). FIG. 10C illustrates a lower container (32) being inserted, which pushes up the latch member (192) at full insertion (194), as shown in FIG. 10D. This causes rotation at the ring member assembly (198, 200), which allows for the upper container (30) to be inserted (202), as shown in FIGS. 10E and 10F. With the upper container in place, the upper container may then be further inserted (204) to function as a plunger interface as shown in FIG. 10G, to mix the components in the lower container (32). Subsequently the mixed components may be removed using a syringe assembly (102, 104) as shown in FIG. 10H and utilized with a patient.

Various exemplary embodiments of the invention are described herein. Reference is made to these examples in a nonlimiting sense. They are provided to illustrate more broadly applicable aspects of the invention. Various changes may be made to the invention described and equivalents may be substituted without departing from the true spirit and scope of the invention. In addition, many modifications may be made to adapt a particular situation, material, composition of matter, process, process act(s) or step(s) to the objective(s), spirit or scope of the present invention. Further, as will be appreciated by those with skill in the art that each of the individual variations described and illustrated herein has discrete components and features which may be readily separated from or combined with the features of any of the other several embodiments without departing from the scope or spirit of the present inventions. All such modifications are intended to be within the scope of claims associated with this disclosure.

Any of the devices described for carrying out the subject diagnostic or interventional procedures may be provided in packaged combination for use in executing such interventions. These supply "kits" may further include instructions for use and be packaged in sterile trays or containers as commonly employed for such purposes.

The invention includes methods that may be performed using the subject devices. The methods may comprise the act of providing such a suitable device. Such provision may be performed by the end user. In other words, the "providing" act merely requires the end user obtain, access, approach, position, set-up, activate, power-up or otherwise act to provide the requisite device in the subject method. Methods recited herein may be carried out in any order of the recited events which is logically possible, as well as in the recited order of events.

Exemplary aspects of the invention, together with details regarding material selection and manufacture have been set forth above. As for other details of the present invention, these may be appreciated in connection with the above-referenced patents and publications as well as generally known or appreciated by those with skill in the art. For example, one with skill in the art will appreciate that one or more lubricious coatings (e.g., hydrophilic polymers such as polyvinylpyrrolidone-based compositions, fluoropolymers such as tetrafluoroethylene, hydrophilic gel or silicones) may be used in connection with various portions of the devices, such as relatively large interfacial surfaces of movably coupled parts, if desired, for example, to facilitate low friction manipulation or advancement of such objects relative to other portions of the instrumentation or nearby tissue structures. The same may hold true with respect to method-based aspects of the invention in terms of additional acts as commonly or logically employed.

In addition, though the invention has been described in reference to several examples optionally incorporating various features, the invention is not to be limited to that which is described or indicated as contemplated with respect to each variation of the invention. Various changes may be made to the invention described and equivalents (whether recited herein or not included for the sake of some brevity) may be substituted without departing from the true spirit and scope of the invention. In addition, where a range of values is provided, it is understood that every intervening value, between the upper and lower limit of that range and any other stated or intervening value in that stated range, is encompassed within the invention.

Also, it is contemplated that any optional feature of the inventive variations described may be set forth and claimed independently, or in combination with any one or more of the features described herein. Reference to a singular item, includes the possibility that there are plural of the same items present. More specifically, as used herein and in claims associated hereto, the singular forms "a," "an," "said," and "the" include plural referents unless the specifically stated otherwise. In other words, use of the articles allow for "at least one" of the subject item in the description above as well as claims associated with this disclosure. It is further noted that such claims may be drafted to exclude any optional element. As such, this statement is intended to serve as antecedent basis for use of such exclusive terminology as "solely," "only" and the like in connection with the recitation of claim elements, or use of a "negative" limitation.

Without the use of such exclusive terminology, the term "comprising" in claims associated with this disclosure shall allow for the inclusion of any additional element—irrespective of whether a given number of elements are enumerated in such claims, or the addition of a feature could be regarded as transforming the nature of an element set forth in such claims. Except as specifically defined herein, all technical and scientific terms used herein are to be given as broad a commonly understood meaning as possible while maintaining claim validity.

The breadth of the present invention is not to be limited to the examples provided and/or the subject specification, but rather only by the scope of claim language associated with this disclosure.

What is claimed is:

1. An assembly for mixing drug components, comprising:

a housing to at least partially hold a first drug component container and a second drug component container;

a transfer member having open first and second ends to fluidly couple the respective first and second drug component containers;

a pressure member to fluidly couple the second drug component container to a pressure generation chamber;

an energy storage member to generate pressure in the pressure generation chamber to transfer a fluid from the second drug component container into the first drug component container;

an exit member to fluidly couple the first drug component container to an exterior of the assembly; and a vent cap having an exit vent fluidly coupled to the exit member to allow a gas to escape the first drug component container when the fluid is transferred from the second drug component container to the first drug component container, thereby reducing a pressure in the first drug component container.

2. The assembly of claim 1, further comprising a piston to generate pressure in the pressure generation chamber.

3. The assembly of claim 2, wherein the energy storage member is configured to move the piston into the pressure generation chamber.

4. The assembly of claim 3, wherein the energy storage member biases the piston to move into the pressure generation chamber to generate pressure therein.

5. The assembly of claim 2, wherein the piston comprises the second drug component container.

6. The assembly of claim 5, further comprising a latch member to prevent insertion of the second drug component container into the assembly until the first drug component container is inserted into the assembly.

7. The assembly of claim 6, wherein the latch member is a selectively rotatable ring.

8. The assembly of claim 2, further comprising a locking member having a locked configuration in which the locking member prevents the piston from moving into the pressure generation chamber to generate pressure therein, and an unlocked configuration in which the locking member does not prevent the piston from moving into the pressure generation chamber.

9. The assembly of claim 8, further comprising an actuation member manually manipulable to move the locking member from the locked configuration to the unlocked configuration.

10. The assembly of claim 9, further comprising a lockout member to prevent movement of the actuation member.

11. The assembly of claim 1, further comprising an exit interface to fluidly couple the assembly to a syringe, wherein the exit interface is fluidly coupled to the exit member, wherein the vent cap is disposed over the exit interface.

12. The assembly of claim 1, further comprising a one-way valve to prevent fluid from flowing from the first drug component container to the second drug component container, while allowing fluid to flow from the second drug component container to the first drug component container.

13. The assembly of claim 1, further comprising a transfer assembly disposed between the first and second drug component containers, wherein the transfer assembly comprises the transfer member, and wherein the transfer assembly is fluidly coupled to the pressure member and the exit member.

14. The assembly of claim 1, wherein the open first end of the transfer member has a geometry to limit an exit rate of a fluid.

15. The system of claim 1, wherein the first drug component container has a first opening, wherein the second drug component container has a second opening, and wherein the first and second openings are opposite each other when the first and second drug component containers are disposed in the housing.

16. The system of claim 1, wherein the energy storage member is a spring to transfer the fluid from the second drug component container into the first drug component container.

17. A method of mixing drug components, comprising:

inserting a first drug component container having a first drug component therein into a drug mixing assembly having a transfer member, a pressure member, an exit member, and a vent cap having an exit vent, wherein inserting the first drug component container into the drug mixing assembly inserts an open first end of the transfer member into the first drug component container;

inserting a second drug component container having a second drug component therein into the drug mixing assembly, wherein inserting the second drug component container into the drug mixing assembly inserts an open second end of the transfer member into the first drug component container, thereby fluidly coupling the first and second drug component containers via the transfer member;

releasing an energy storage member to automatically move a pressure fluid into the second drug component container via the pressure member to increase a pressure in the second drug component container, thereby forcing at least some of the second drug component to move from the second drug component container into the first drug component container;

allowing a gas to escape the first drug component container through the exit vent in the vent cap when the at least some of the second drug component moves from the second drug component container into the first drug component container, thereby reducing a pressure in the first drug component container; and moving the drug mixing assembly to mix the first and second drug components in the first drug component container to form a prepared drug.

18. The method of claim 17, further comprising:

removing the vent cap from the drug mixing assembly;

coupling a syringe to the drug mixing assembly such that the syringe is fluidly coupled to the first drug component container via the exit member; and withdrawing the prepared drug from the first drug component container and into the syringe through the exit member.

19. The method of claim 17, wherein releasing the energy storage member automatically moves a piston into a pressure generation chamber in the drug mixing assembly to move the pressure fluid from the pressure generation chamber into the second drug component container.

20. The method of claim 19, wherein the energy storage member is biased to move the piston into the pressure generation chamber to generate pressure therein.

* * * * *